US009972899B2

(12) United States Patent
Jan et al.

(10) Patent No.: US 9,972,899 B2
(45) Date of Patent: May 15, 2018

(54) PLANAR DUAL POLARIZATION ANTENNA AND COMPLEX ANTENNA

(71) Applicant: Wistron NeWeb Corporation, Hsinchu (TW)

(72) Inventors: Cheng-Geng Jan, Hsinchu (TW); Chieh-Sheng Hsu, Hsinchu (TW)

(73) Assignee: Wistron NeWeb Corporation, Hsinchu (TW)

( * ) Notice: Subject to any disclaimer, the term of this patent is extended or adjusted under 35 U.S.C. 154(b) by 477 days.

(21) Appl. No.: 14/824,053

(22) Filed: Aug. 11, 2015

(65) Prior Publication Data

US 2016/0126617 A1 May 5, 2016

(30) Foreign Application Priority Data

Nov. 5, 2014 (TW) ..... 103138387 A

(51) Int. Cl.

| | |
|---|---|
| ***H01Q 1/48*** | (2006.01) |
| ***H01Q 1/38*** | (2006.01) |
| ***H01Q 9/04*** | (2006.01) |
| ***H01Q 21/00*** | (2006.01) |
| ***H01Q 21/08*** | (2006.01) |

(52) U.S. Cl.

CPC ..... *H01Q 1/38* (2013.01); *H01Q 9/0414* (2013.01); *H01Q 9/0435* (2013.01); *H01Q 21/0075* (2013.01); *H01Q 21/08* (2013.01)

(58) Field of Classification Search

CPC ..... H01Q 1/38; H01Q 9/0414; H01Q 9/0435; H01Q 21/0076; H01Q 21/08

See application file for complete search history.

(56) References Cited

U.S. PATENT DOCUMENTS

| | | | |
|---|---|---|---|
| 4,903,033 | A | 2/1990 | Tsao |
| 5,691,734 | A | 11/1997 | Davies |

(Continued)

FOREIGN PATENT DOCUMENTS

| | | | |
|---|---|---|---|
| CN | 202363587 | U | 8/2012 |
| CN | 105406190 | A | 3/2016 |
| JP | 5-129825 | | 5/1993 |
| TW | 200818599 | | 4/2008 |
| TW | 201236267 | A1 | 9/2012 |

OTHER PUBLICATIONS

Hsu, Title of Invention: Planar Dual Polarization Antenna and Complex Antenna, U.S. Appl. No. 14/700,150, filed Apr. 30, 2015.

(Continued)

*Primary Examiner* — Dameon E Levi
*Assistant Examiner* — David Lotter
(74) *Attorney, Agent, or Firm* — Winston Hsu

(57) ABSTRACT

A planar dual polarization antenna for receiving and transmitting radio signals includes an upper patch plate and a metal grounding plate with a width along a first direction and a length along a second direction. A shape of the upper patch plate has a first symmetry axis along the first direction and a second symmetry axis along the second direction. The first symmetry axis divides the upper patch plate into a first section and a third section. The second symmetry axis divides the upper patch plate into a second section and a fourth section. A first geometry center of the first section and the symmetry center are separated by a first distance, and a second geometry center of the second section and the symmetry center are separated by a second distance unequal to the first distance.

18 Claims, 26 Drawing Sheets

(56) References Cited

U.S. PATENT DOCUMENTS

| | | | | |
|---|---|---|---|---|
| 5,706,015 | A | 1/1998 | Chen | |
| 6,335,703 | B1 | 1/2002 | Chang | |
| 6,531,984 | B1 | 3/2003 | Johannisson | |
| 7,253,770 | B2 | 8/2007 | Yegin | |
| 7,423,595 | B2 | 9/2008 | Säily | |
| 7,432,862 | B2 | 10/2008 | Heyde | |
| 8,564,484 | B2 | 10/2013 | Jan | |
| 9,490,538 | B2 | 11/2016 | Hsu | |
| 2007/0229359 | A1 | 10/2007 | Heyde | |
| 2008/0266192 | A1 | 10/2008 | Tuttle | |
| 2012/0212376 | A1* | 8/2012 | Jan | H01Q 9/0414 343/700 MS |
| 2013/0063310 | A1* | 3/2013 | Mak | H01Q 1/246 343/700 MS |

OTHER PUBLICATIONS

S. Gao, L. W. Li, M. S. Leong, and T. S. Yeo, "A Broad-Band Dual-Polarized Microstrip Patch Antenna With Aperture Coupling" IEEE Transactions on Antennas and Propagation, vol. 51, No. 4, Apr. 2003, p. 898-900.

Andrea Vallecchi and Guido Biffi Gentili, "A Shaped-Beam Hybrid Coupling Microstrip Planar Array Antenna for X-Band Dual Polarization Airport Surveillance Radars" Antennas and Propagation, 2007. EuCAP 2007. The Second European Conference dated Nov. 11-16, 2007.

Kin-Lu Wong, "Compact and Broadband Microstrip Antennas", p. 125-128, Copyright 2002 John Wiley & Sons, Inc., 2002.

* cited by examiner

| | X | Y |
|---|---|---|
| m1 | 0.0000 | 10.5321 |
| m2 | -180.0000 | -0.4875 |
| m3 | -37.5000 | 7.5140 |
| m4 | 35.5000 | 7.5874 |
| m5 | -30.0000 | 8.6115 |
| m6 | -30.0000 | -8.2592 |

| | X | Y |
|---|---|---|
| m1 | 0.0000 | 10.6444 |
| m2 | -180.0000 | -0.2536 |
| m3 | -37.0000 | 7.6761 |
| m4 | 35.0000 | 7.6321 |
| m5 | -30.0000 | 8.7059 |
| m6 | -30.0000 | -10.5984 |

| | X | Y |
|---|---|---|
| m1 | 0.0000 | 10.7515 |
| m2 | -180.0000 | 0.5824 |
| m3 | -37.0000 | 7.7324 |
| m4 | 34.0000 | 7.7709 |
| m5 | -30.0000 | 8.7808 |
| m6 | -30.0000 | -11.0207 |

| | X | Y |
|---|---|---|
| m1 | 0.0000 | 10.8115 |
| m2 | -180.0000 | 1.1288 |
| m3 | -37.0000 | 7.7389 |
| m4 | 33.0000 | 7.7474 |
| m5 | -30.0000 | 8.8138 |
| m6 | -30.0000 | -7.6320 |

| | X | Y |
|---|---|---|
| m1 | 0.0000 | 10.4641 |
| m2 | -180.0000 | -0.5957 |
| m3 | -37.5000 | 7.4582 |
| m4 | 35.5000 | 7.5131 |
| m5 | -30.0000 | 8.5558 |
| m6 | -30.0000 | -8.7338 |

| | X | Y |
|---|---|---|
| m1 | 0.0000 | 10.6484 |
| m2 | -180.0000 | -0.6728 |
| m3 | -37.0000 | 7.6855 |
| m4 | 35.0000 | 7.6322 |
| m5 | -30.0000 | 8.7173 |
| m6 | -30.0000 | -11.6047 |

| | X | Y |
|---|---|---|
| m1 | 0.0000 | 10.7272 |
| m2 | -180.0000 | -0.1268 |
| m3 | -37.0000 | 7.7034 |
| m4 | 34.0000 | 7.7478 |
| m5 | -30.0000 | 8.7563 |
| m6 | -30.0000 | -12.2981 |

| | X | |
|---|---|---|
| m1 | 0.0000 | 11.3132 |
| m2 | -180.0000 | 0.8979 |
| m3 | -36.5000 | 8.2712 |
| m4 | 33.0000 | 8.2632 |
| m5 | -30.0000 | 9.2784 |
| m6 | -30.0000 | -7.7849 |

| | X | Y |
|---|---|---|
| m1 | 0.0000 | 10.5121 |
| m2 | -180.0000 | -0.6122 |
| m3 | -37.5000 | 7.5071 |
| m4 | 35.5000 | 7.5764 |
| m5 | -30.0000 | 8.6013 |
| m6 | -30.0000 | -8.1390 |

| | X | Y |
|---|---|---|
| m1 | 0.0000 | 10.6535 |
| m2 | -180.0000 | -0.4680 |
| m3 | -37.0000 | 7.6916 |
| m4 | 35.0000 | 7.6568 |
| m5 | -30.0000 | 8.7201 |
| m6 | -30.0000 | -10.6180 |

| | X | Y |
|---|---|---|
| m1 | 0.0000 | 10.7629 |
| m2 | -180.0000 | 0.3048 |
| m3 | -37.0000 | 7.7458 |
| m4 | 34.0000 | 7.8052 |
| m5 | -30.0000 | 8.7941 |
| m6 | -30.0000 | -11.3858 |

| | X | Y |
|---|---|---|
| m1 | 0.0000 | 11.0436 |
| m2 | -180.0000 | 1.0400 |
| m3 | -36.5000 | 8.0414 |
| m4 | 33.0000 | 8.0161 |
| m5 | -30.0000 | 9.0362 |
| m6 | -30.0000 | -8.0683 |

PLANAR DUAL POLARIZATION ANTENNA AND COMPLEX ANTENNA

BACKGROUND OF THE INVENTION

1. Field of the Invention

The present invention relates to a planar dual polarization antenna and a complex antenna, and more particularly, to a planar dual polarization antenna and a complex antenna of broadband, wide beamwidth, high antenna gain, better common polarization to cross polarization (Co/Cx) value, smaller size, and meeting 45-degree slant polarization requirements.

2. Description of the Prior Art

Electronic products with wireless communication functionalities, e.g. notebook computers, personal digital assistants, etc., utilize antennas to emit and receive radio waves, to transmit or exchange radio signals, so as to access a wireless communication network. Therefore, to facilitate a user's access to the wireless communication network, an ideal antenna should maximize its bandwidth within a permitted range, while minimizing physical dimensions to accommodate the trend for smaller-sized electronic products. Additionally, with the advance of wireless communication technology, electronic products may be configured with an increasing number of antennas. For example, a long term evolution (LTE) wireless communication system and a wireless local area network standard IEEE 802.11n both support multi-input multi-output (MIMO) communication technology, i.e. an electronic product is capable of concurrently receiving/transmitting wireless signals via multiple (or multiple sets of) antennas, to vastly increase system throughput and transmission distance without increasing system bandwidth or total transmission power expenditure, thereby effectively enhancing spectral efficiency and transmission rate for the wireless communication system, as well as improving communication quality. Moreover, MIMO communication systems can employ techniques such as spatial multiplexing, beam forming, spatial diversity, precoding, etc. to further reduce signal interference and to increase channel capacity.

The LTE wireless communication system includes 44 bands which cover from 698 MHz to 3800 MHz. Due to the bands being separated and disordered, a mobile system operator may use multiple bands simultaneously in the same country or area. Under such a situation, conventional dual polarization antennas may not be able to cover all the bands, such that transceivers of the LTE wireless communication system cannot receive and transmit wireless signals of multiple bands. Therefore, it is a common goal in the industry to design antennas that suit both transmission demands, as well as dimension and functionality requirements.

SUMMARY OF THE INVENTION

Therefore, the present invention provides a planar dual polarization antenna to effectively increase antenna beamwidth.

An embodiment of the present invention discloses a planar dual polarization antenna for receiving and transmitting radio signals, comprising a metal grounding plate having a width along a first direction and a length along a second direction; and an upper patch plate, wherein a shape of the upper patch plate has a first symmetry axis along the first direction and a second symmetry axis along the second direction, the first symmetry axis divides the upper patch plate into a first section and a third section, and the second symmetry axis divides the upper patch plate into a second section and a fourth section; wherein a symmetry center of the shape is aligned to a center point of the metal grounding plate, a first geometry center of the first section and the symmetry center are separated by a first distance, and a second geometry center of the second section and the symmetry center are separated by a second distance unequal to the first distance.

An embodiment of the present invention further discloses a complex antenna for receiving and transmitting radio signals, comprising a metal grounding plate comprising a plurality of rectangular regions, each of the plurality of rectangular regions has a width along a first direction and a length along a second direction; and an upper planar dual polarization antenna layer comprising a plurality of upper patch plates disposed corresponding to the plurality of rectangular regions respectively, wherein a shape of each of the plurality of the upper patch plates has a first symmetry axis along the first direction and a second symmetry axis along the second direction, the first symmetry axis divides the upper patch plate into a first section and a third section, and the second symmetry axis divides the upper patch plate into a second section and a fourth section; wherein a symmetry center of the shape is aligned to a center point of the corresponding rectangular region, a first geometry center of the first section and the symmetry center are separated by a first distance, and a second geometry center of the second section and the symmetry center are separated by a second distance unequal to the first distance.

These and other objectives of the present invention will no doubt become obvious to those of ordinary skill in the art after reading the following detailed description of the preferred embodiment that is illustrated in the various figures and drawings.

DETAILED DESCRIPTION

Figure 1A:
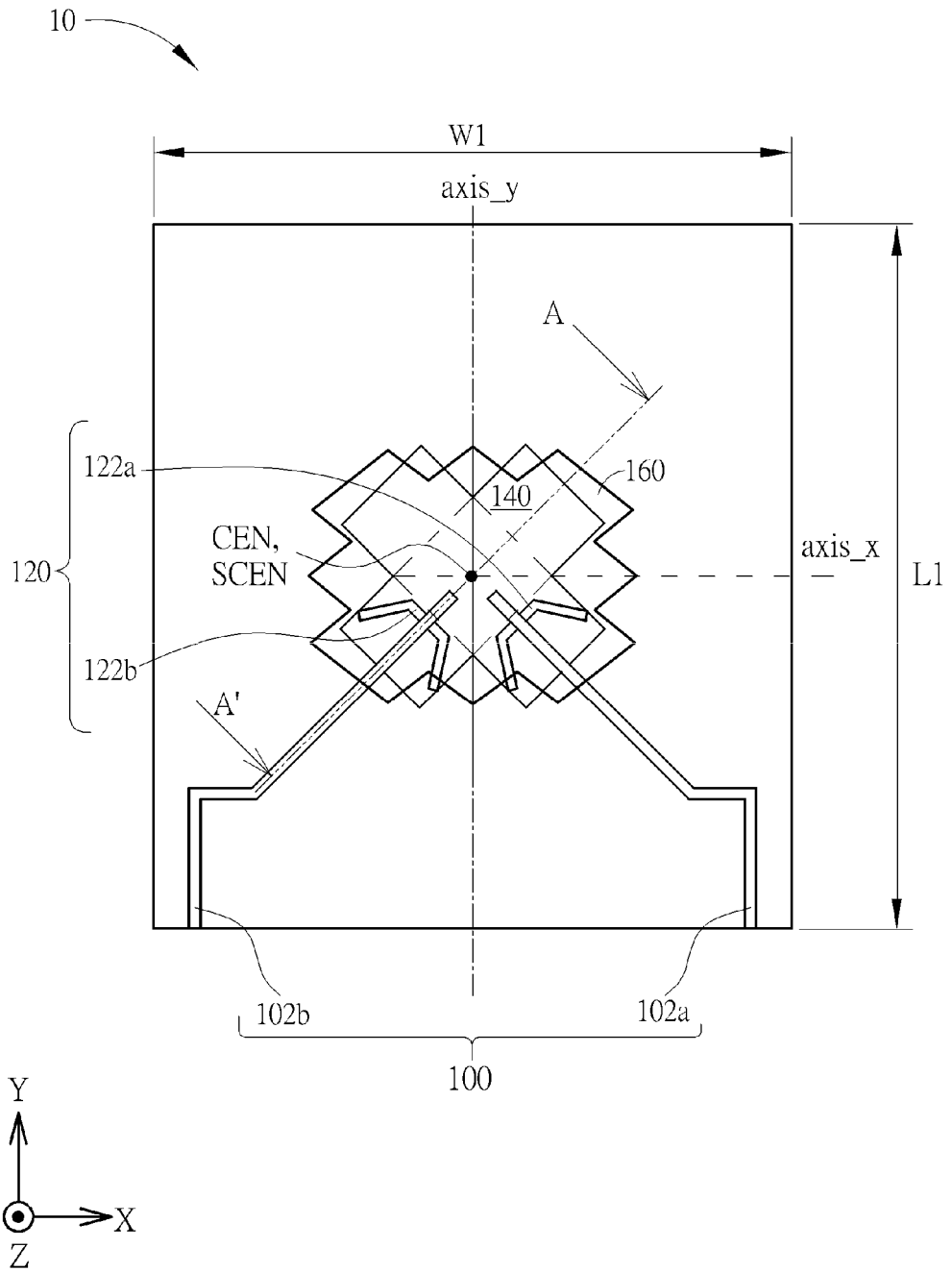
FIG. 1A is a top-view schematic diagram illustrating a planar dual polarization antenna according to an embodiment of the present invention.
Figure 1B:
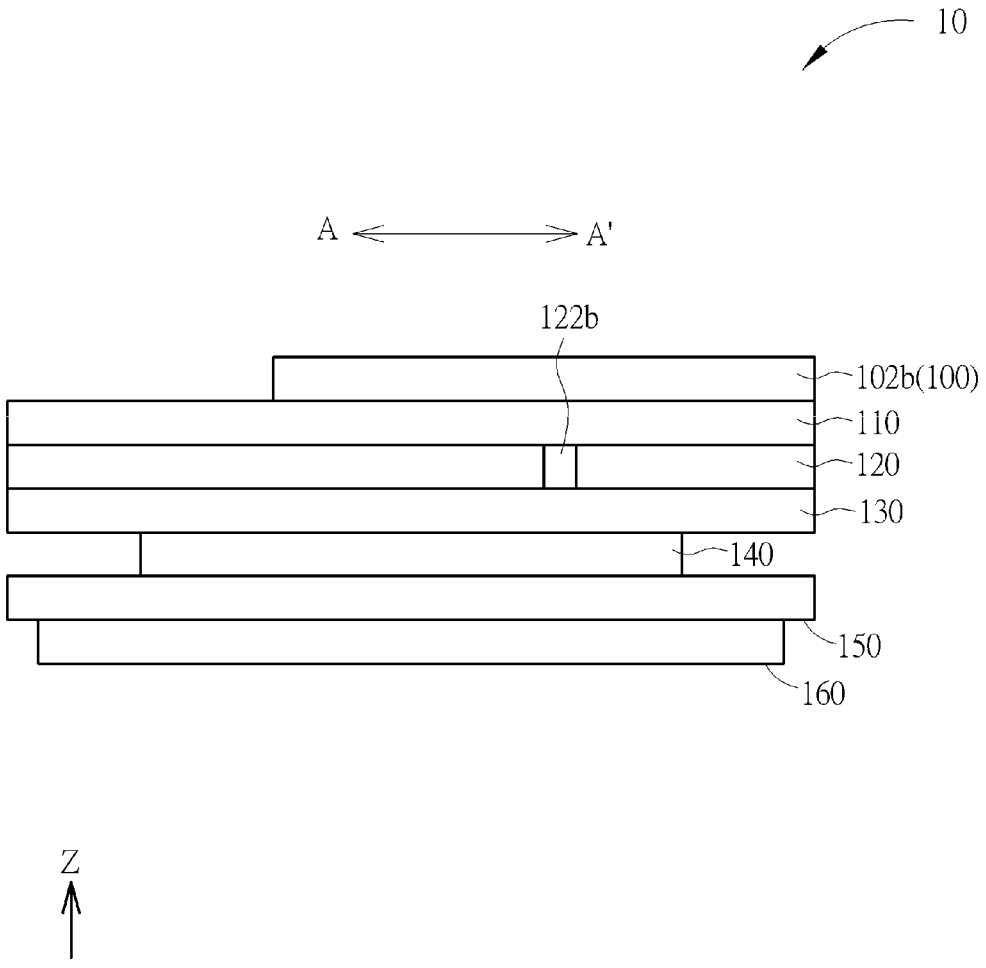
FIG. 1B is a cross-sectional view diagram of the planar dual polarization antenna taken along a cross-sectional line A-A' in FIG. 1A.

FIG. 1A is a top-view schematic diagram illustrating a planar dual polarization antenna 10 according to an embodiment of the present invention. FIG. 1B is a cross-sectional view diagram of the planar dual polarization antenna 10 taken along a cross-sectional line A-A' in FIG. 1A. The planar dual polarization antenna 10 is utilized to receive and transmit radio signals of a broad band or different frequency bands, such as radio signals in Band 40 and Band 41 of an LTE wireless communication system (Band 40: substantially 2.3 GHz-2.4 GHz, Band 41: substantially 2.496 GHz-2.690 GHz). As shown in FIGS. 1A and 1B, the planar dual polarization antenna 10 is substantially a seven-layered square architecture of reflection symmetry with respect to symmetry axes axis_x and axis_y along directions x and y, respectively. The planar dual polarization antenna 10 comprises a feeding transmission line layer 100, dielectric layers 110, 130, 150, a metal grounding plate 120, a lower patch plate 140 and an upper patch plate 160. A symmetry center point SCEN of the lower patch plate 140 and the upper patch plate 160 are aligned to a center point CEN of the metal grounding plate 120. The feeding transmission line layer 100 comprises feeding transmission lines 102*a* and 102*b* which are symmetric with respect to a symmetry axis axis_y and orthogonal to feed in radio signals of two polarizations. The metal grounding plate 120 is used for providing a ground and comprises slots 122*a* and 122*b*, which are orthogonal to the feeding transmission lines 102*a* and 102*b*, respectively. The slots 122*a* and 122*b* are symmetry to the symmetry axis axis_y so as to generate an orthogonal dual-polarized antenna pattern. The lower patch plate 140 is the main radiating body and has a shape substantially conforming to a cross pattern in order to generate electromagnetic waves with linear polarization but not circular polarization. The upper patch plate 160 is utilized to increase resonance bandwidth of the planar dual polarization antenna 10, and is electrically isolated from the lower patch plate 140 by the dielectric layer 150. Besides, since the feeding transmission line layer 100, the metal grounding plate 120 and the lower patch plate 140 are isolated by the dielectric layers 110 and 130 and parallel to one another, the feeding transmission line layer 100 is coupled to the lower patch plate 140 by means of the slots of the metal grounding plate 120—that is to say, radio signals from the feeding transmission lines (e.g., the feeding transmission line 102*a*) are coupled to the slots (e.g., the slot 122*a*), and then coupled to the lower patch plate 140 when the slots (i.e., the slot 122*a*) resonates—to increase antenna bandwidth. The resonance direction of the lower patch plate 140 with the shape substantially conforming to a cross pattern tilts with respect to the metal grounding plate 120, and this effectively minimizes the size of the planar dual polarization antenna 10 while meeting 45-degree slant polarization requirements.

Briefly, a length L1 of the metal grounding plate 120 along the symmetry axis axis_y is longer than a width W1 of the metal grounding plate 120 along the direction x, thereby increasing 3 dB beamwidth in the horizontal plane. The upper patch plate 160 is spread out to be more distributed along the direction x in order to balance the asymmetry/inequivalence of the length L1 and the width W1 and thus improve common polarization to cross polarization (Co/Cx) value.

Figure 2A:
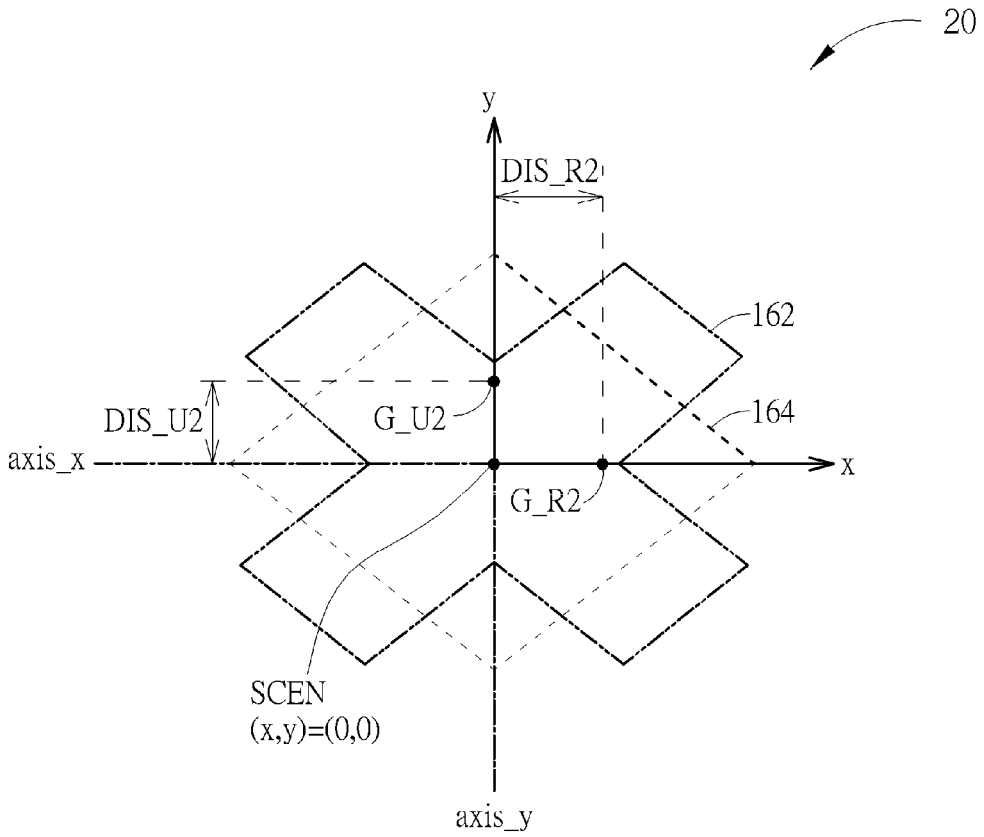
FIG. 2A is a schematic diagram illustrating a cross quadrate pattern according to an embodiment of the present invention.
Figure 2B:
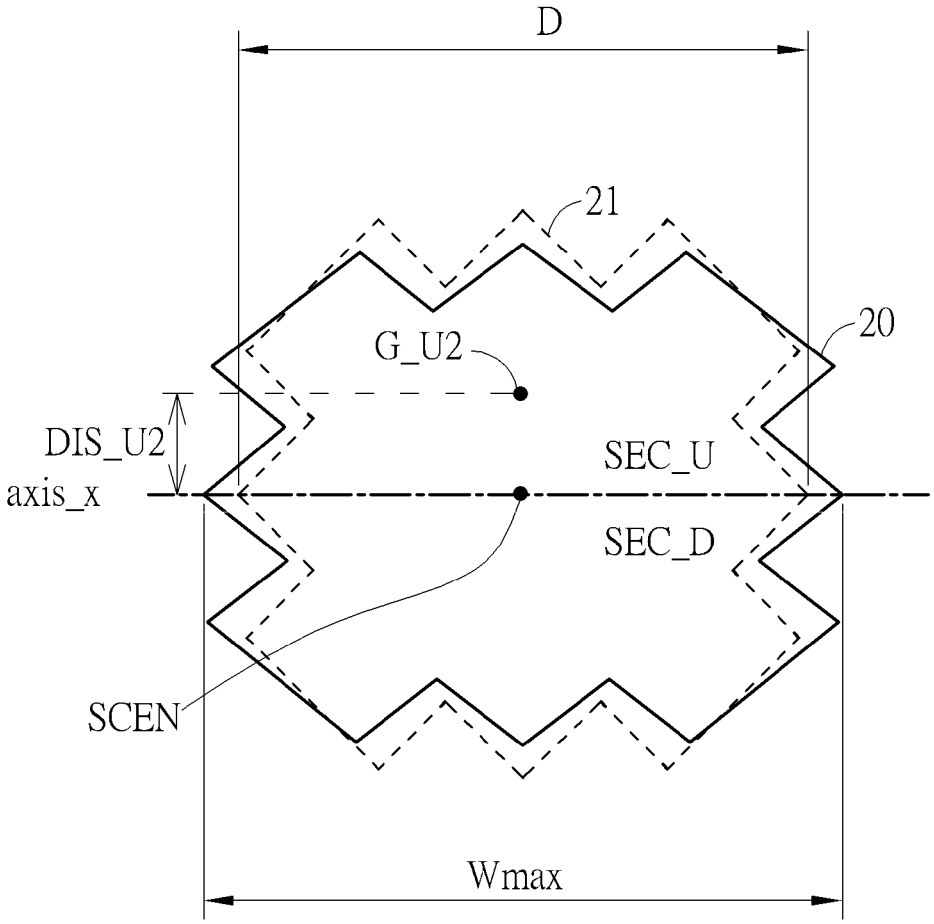
FIGS. 2B and 2C are schematic diagrams illustrating comparison between the cross quadrate pattern shown in FIG. 2A and another cross quadrate pattern.
Figure 2C:
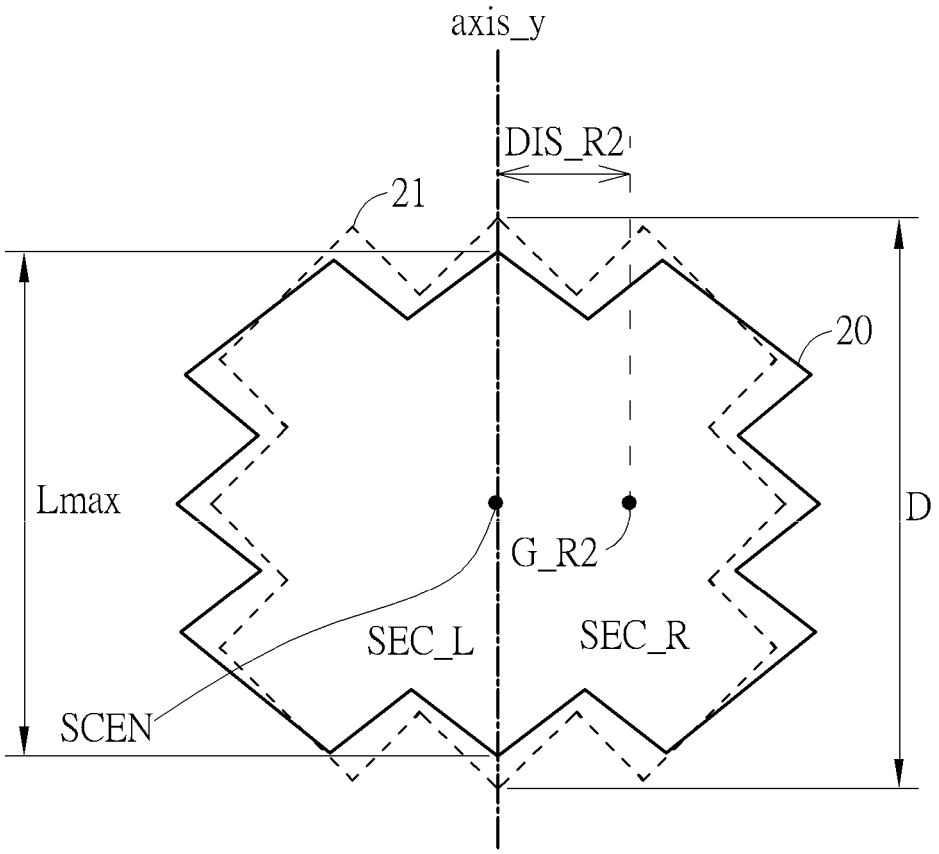

Specifically, to increase the beamwidth in horizontal plane (i.e., the xz plane), the width W1 of the metal grounding plate 120 along the direction x must be shortened to make the antenna pattern in horizontal plane diverge. It turns out that the length L1 of the metal grounding plate 120 along the symmetry axis axis_y is longer than the width W1 of the metal grounding plate 120 along the direction x. Since the length L1 is not equal to the width W1, equivalent resonance lengths in the vertical direction and in the horizontal direction will differ. The shape of the upper patch plate 160, however, could balance the asymmetry due to the uneven quantities between the length L1 and the width W1. It is because the upper patch plate 160 has the shape substantially conforming to a cross pattern, and a cross pattern comprises structures such as a cross quadrate pattern according to common knowledge such as from Wikipedia, for example. Please refer to FIGS. 2A to 2C. FIG. 2A is a schematic diagram illustrating a cross quadrate pattern 20 according to an embodiment of the present invention. FIGS. 2B and 2C are schematic diagrams illustrating comparison between the cross quadrate pattern 20 shown in FIG. 2A and another cross quadrate pattern 21. Both the cross quadrate patterns 20 and 21 have shapes substantially conforming to cross patterns. Particularly, across section 162 and a quadrilateral section 164 overlapping constitute the cross quadrate pattern 20 with a maximum width Wmax and a maximum length Lmax along the directions x and y respectively, while a cross section and a square section overlapping constitute the cross quadrate pattern 21 with maximum dimensions along the directions x and y equal to a reference dimension D corresponding to the resonance bandwidth, such that the dimensions of the cross quadrate pattern 21 are related to antenna operation frequency. Compared to the cross quadrate pattern 21, the cross quadrate pattern 20 extends along the direction x (meaning that the area of the cross quadrate pattern 20 is spread out to be more distributed toward the direction x) to satisfy the equation $$D = \frac{Wmax}{Ax} = \frac{Lmax}{Ay},$$

where ratio values Ax and Ay respectively denote the extent to which the dimensions of the cross quadrate pattern 20 are adjusted with respect to the reference dimension D according to the asymmetry of the metal grounding plate 120. Therefore, the dimensions of the cross quadrate pattern 20 are related to antenna operation frequency and can be adjusted according to the inequivalence of the length L1 and the width W1. It is worth noting that the ratio values Ax and Ay can be close to or even equal to 1 so as to prevent resonance frequency from shifting to change the resonance bandwidth as the cross quadrate pattern 20 is reshaped.

As shown in FIG. 2B, the symmetry axis axis_x of the cross quadrate pattern 20 divides the cross quadrate pattern 20 into a section SEC_U with a geometry center G_U2 and a section SEC_D. Similarly, the symmetry axis axis_y of the cross quadrate pattern 20 divides the cross quadrate pattern 20 into a section SEC_R with a geometry center G_R2 and a section SEC_L as shown in FIG. 2C. If the symmetry center SCEN of the cross quadrate pattern 20 has an x-coordinate of 0 and a y-coordinate of 0, the coordinates of the geometry centers G_U2, G_R2 are labeled as $$(x, y) = \left(0, \frac{\int_0^{\infty}\int_{-\infty}^{\infty} f(x, y)y\partial x\partial y}{\int_0^{\infty}\int_{-\infty}^{\infty} f(x, y)\partial x\partial y}\right) \text{ and } (x, y) = \left(\frac{\int_{-\infty}^{\infty}\int_0^{\infty} f(x, y)x\partial x\partial y}{\int_{-\infty}^{\infty}\int_0^{\infty} f(x, y)\partial x\partial y}, 0\right)$$

respectively, where the output of the function $f(x,y)$ corresponding to the input (x,y) located within the cross quadrate pattern 20 equals to 1 (i.e., $f(x,y)=1$), and the output of the function $f(x,y)$ corresponding to the input (x,y) located outside the cross quadrate pattern 20 equals to 0 (i.e., $f(x,y)=0$). In such a situation, the geometry center G_U2 and the symmetry center SCEN are separated by a distance DIS_U2 which equals to $$\frac{\int_0^{\infty}\int_{-\infty}^{\infty} f(x, y)y\partial x\partial y}{\int_0^{\infty}\int_{-\infty}^{\infty} f(x, y)\partial x\partial y}$$

(i.e., $$\text{DIS_U2} = \frac{\int_0^{\infty}\int_{-\infty}^{\infty} f(x, y)y\partial x\partial y}{\int_0^{\infty}\int_{-\infty}^{\infty} f(x, y)\partial x\partial y}\Bigg).$$

The geometry center G_R2 and the symmetry center SCEN are separated by a distance DIS_R2 which equals to $$\frac{\int_{-\infty}^{\infty}\int_0^{\infty} f(x, y)x\partial x\partial y}{\int_{-\infty}^{\infty}\int_0^{\infty} f(x, y)\partial x\partial y}$$

(i.e., $$\text{DIS_R2} = \frac{\int_{-\infty}^{\infty}\int_0^{\infty} f(x, y)x\partial x\partial y}{\int_{-\infty}^{\infty}\int_0^{\infty} f(x, y)\partial x\partial y}\Bigg).$$

The distance DIS_U2 is less than the distance DIS_R2, meaning that the area of the cross quadrate pattern 20 tends to be distributed toward the direction x.

Figure 3:
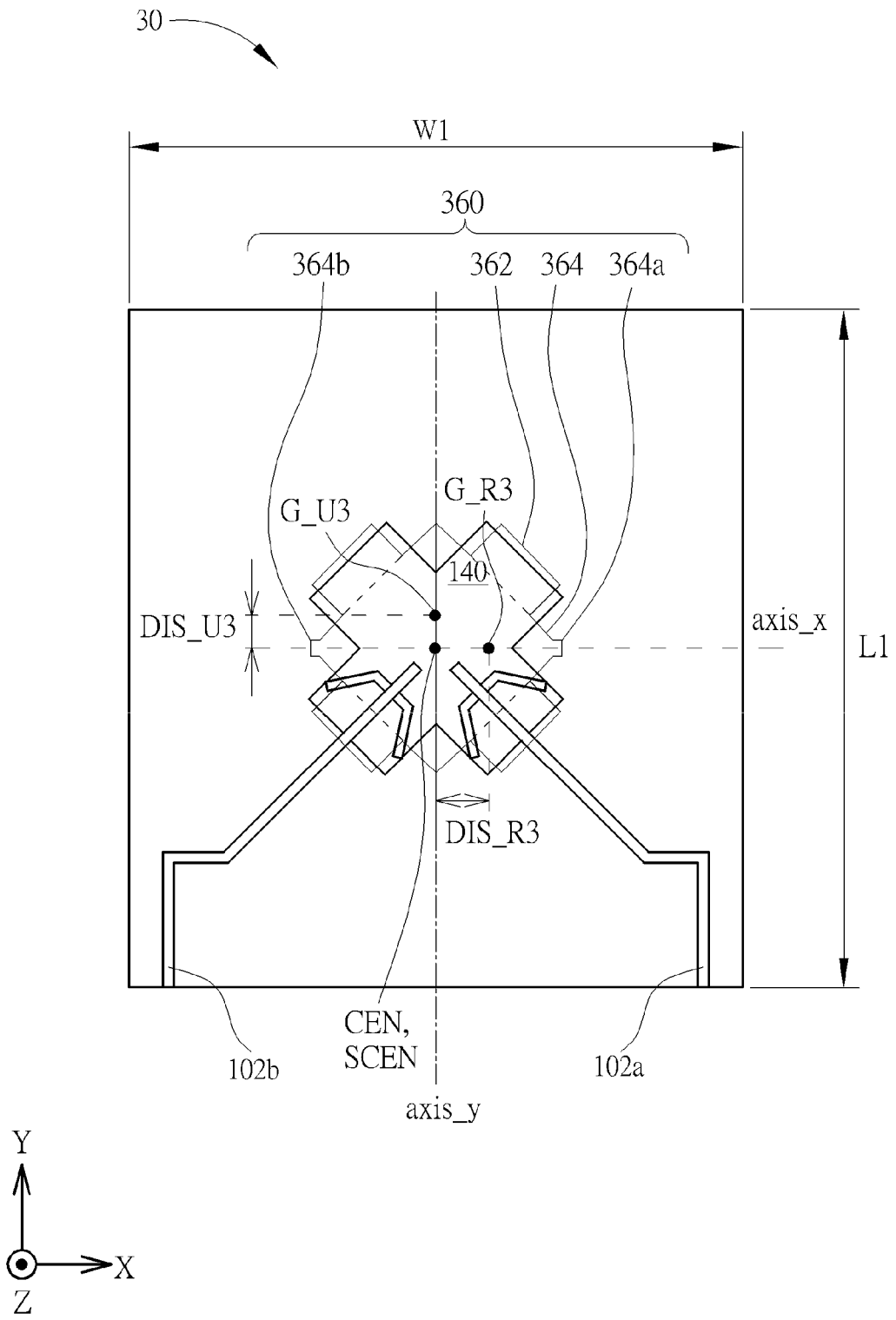
FIG. 3 is a top-view schematic diagram illustrating a planar dual polarization antenna according to an embodiment of the present invention.

Please note that the planar dual polarization antenna 10 as shown in FIG. 1A and FIG. 1B is an exemplary embodiment of the invention, and those skilled in the art can make alternations and modifications accordingly. For example, the shape of the upper patch plate 160 may be modified to spread the upper patch plate 160 further out along the direction x. FIG. 3 is a top-view schematic diagram illustrating a planar dual polarization antenna 30 according to an embodiment of the present invention. Since the structure of the planar dual polarization antenna 30 is similar to that of the planar dual polarization antenna 10 shown in FIG. 1A, the same numerals and notations denote the same components in the following description, and the similar parts are not detailed redundantly. Different from the planar dual polarization antenna 10, dimensions of across section 362 of a upper patch plate 360 of the planar dual polarization antenna 30 along the directions x and y are equal to reference dimensions corresponding to the resonance bandwidth respectively; that is to say, the ratio values Ax and Ay are equal to 1. In addition, a quadrilateral section 364 of the upper patch plate 360 comprises protrusion portions 364*a* and 364*b*. Therefore, a distance DIS_U3 between a geometry center G_U3 and the symmetry center SCEN is less than a distance DIS_R3 between a geometry center G_R3 and the symmetry center SCEN, and this means that the upper patch plate 360 is spread out to be more distributed along the direction x.

Figure 4:
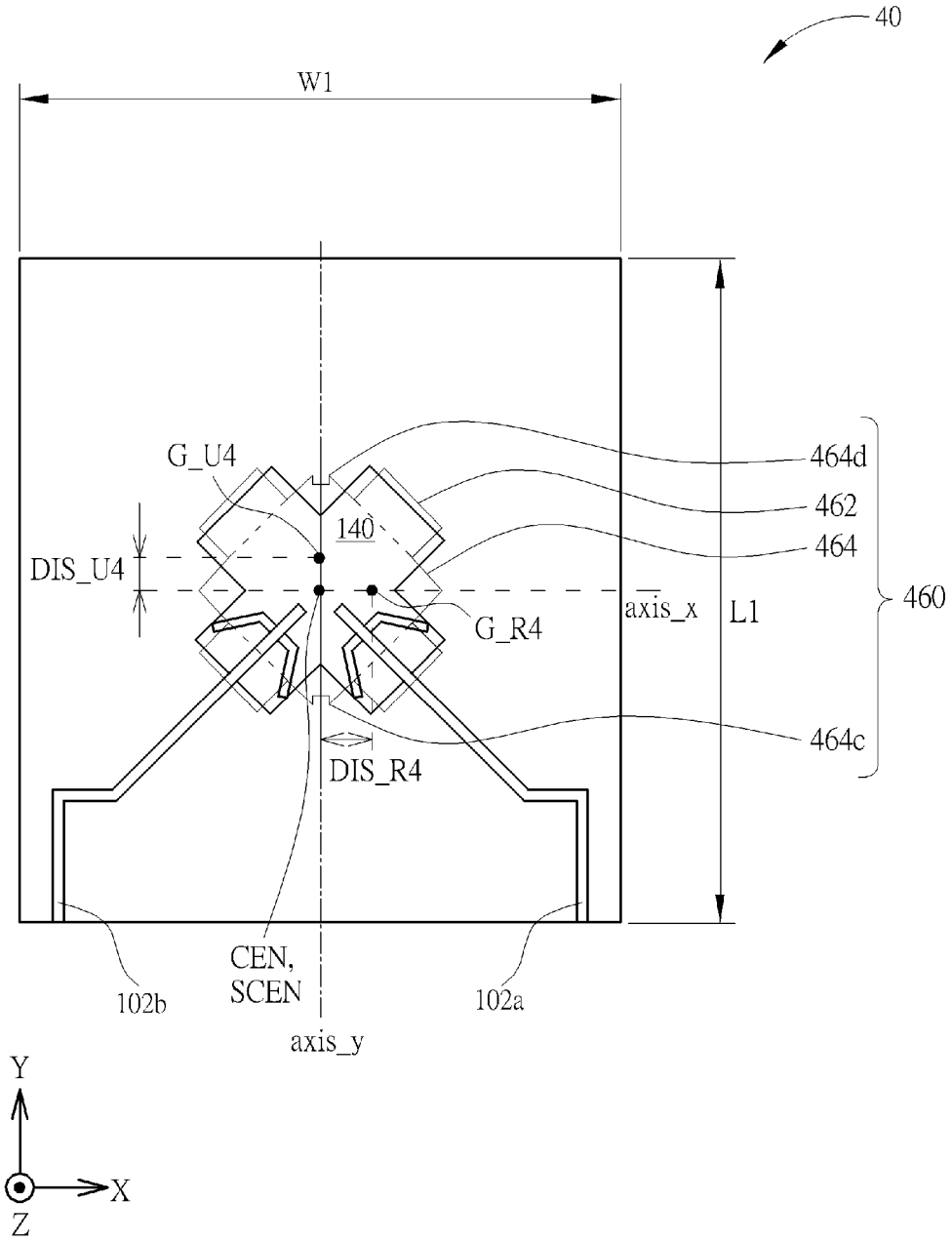
FIG. 4 is a top-view schematic diagram illustrating a planar dual polarization antenna according to an embodiment of the present invention.
Figure 5:
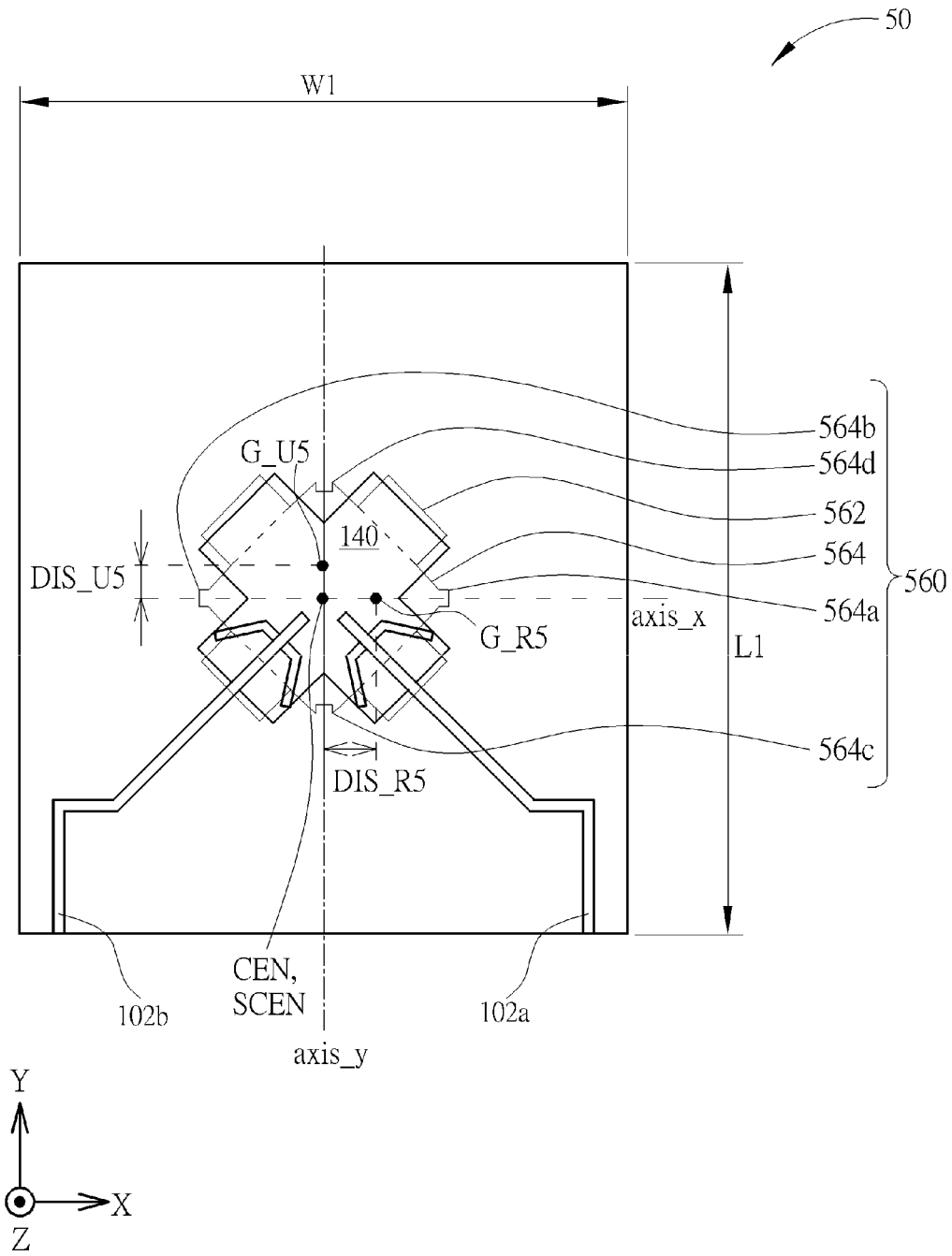
FIG. 5 is a top-view schematic diagram illustrating a planar dual polarization antenna according to an embodiment of the present invention.

Besides, FIG. 4 is a top-view schematic diagram illustrating a planar dual polarization antenna 40 according to an embodiment of the present invention. The structure of the planar dual polarization antenna 40 is similar to that of the planar dual polarization antenna 10, and hence the same numerals and notations denote the same components in the following description. Different from the planar dual polarization antenna 10, dimensions of a cross section 462 of a upper patch plate 460 of the planar dual polarization antenna 40 along the directions x and y are equal to the reference dimensions corresponding to the resonance bandwidth respectively; that is to say, the ratio values Ax and Ay are equal to 1. Additionally, a quadrilateral section 464 of the upper patch plate 460 comprises notches 464*c* and 464*d*. Consequently, a distance DIS_U4 between a geometry center G_U4 and the symmetry center SCEN is less than a distance DIS_R4 between a geometry center G_R4 and the symmetry center SCEN, and this means that the upper patch plate 460 is spread out to be more distributed along the direction x. Similarly, FIG. 5 is a top-view schematic diagram illustrating a planar dual polarization antenna 50 according to an embodiment of the present invention. The structure of the planar dual polarization antenna 50 is similar to that of the planar dual polarization antenna 40, and hence the same numerals and notations denote the same components in the following description. Different from the planar dual polarization antenna 40, a quadrilateral section 564 of the upper patch plate 560 comprises protrusion portions 564*a*, 564*b* and notches 564*c*, 564*d*. As a result, a distance DIS_U5 between a geometry center G_U5 and the symmetry center SCEN is less than a distance DIS_R5 between a geometry center G_R5 and the symmetry center SCEN, and this means that the upper patch plate 560 is spread out to be more distributed along the direction x.

As set forth above, when the ratio values Ax and Ay are equal to 1, the upper patch plate does not extend or contract in one direction only. However, with the protrusion portions or the notches of the quadrilateral section of the upper patch plate, the geometry centers of different sections of the upper patch plate (divided by the symmetry axes axis_x or axis_y) are separated from the symmetry center SCEN of the upper patch plate by different distances to make area more distributed toward the direction x.

Figure 6:
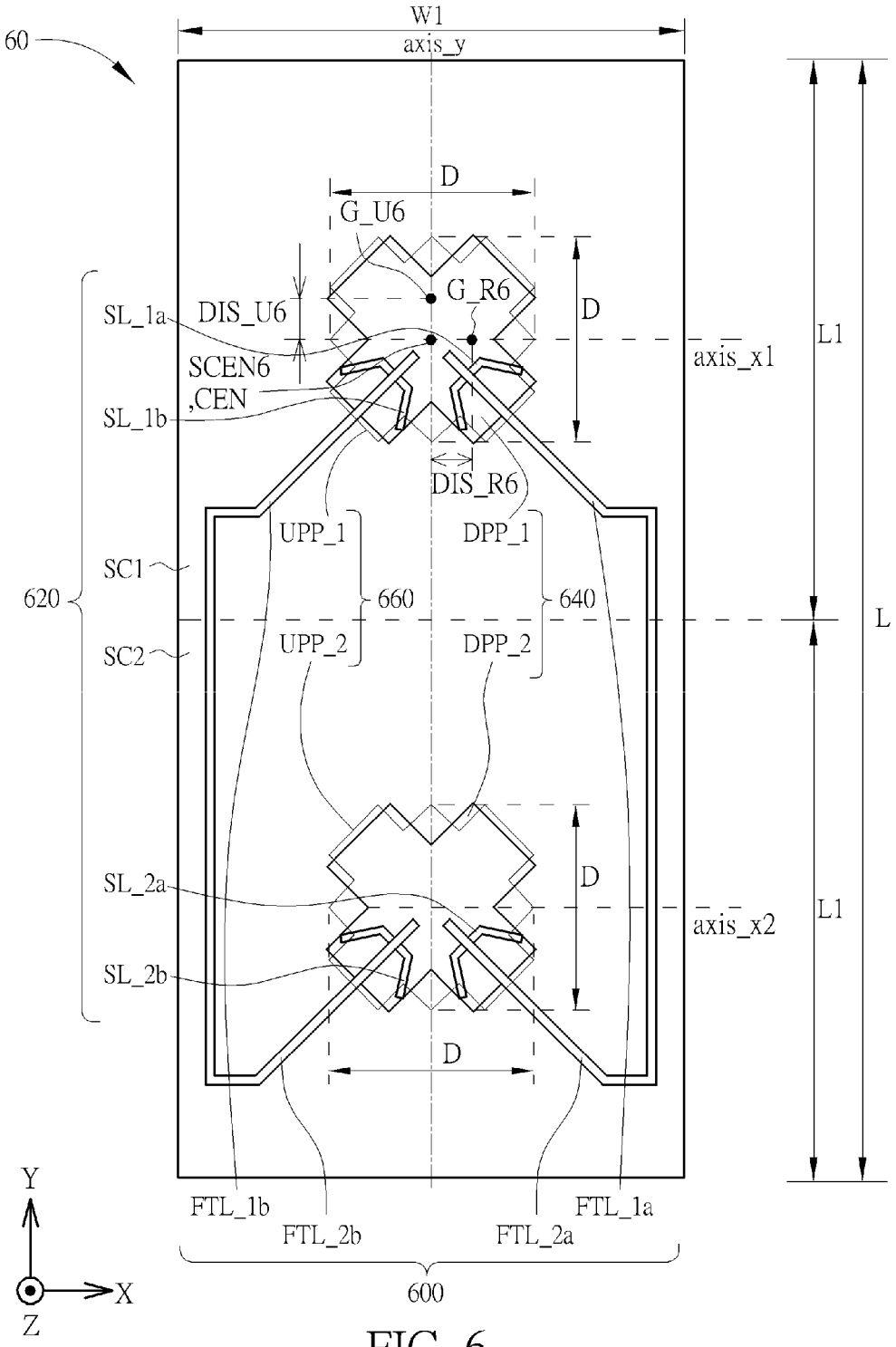
FIG. 6 is a top-view schematic diagram illustrating a complex antenna according to an embodiment of the present invention.

On the other hand, to enhance antenna gain, the planar dual polarization antenna 10, 30, 40 and 50 may be arranged to form an array antenna. FIG. 6 is a top-view schematic diagram illustrating a complex antenna 60 according to an embodiment of the present invention. Similar to the planar dual polarization antenna 10, the complex antenna 60 is a seven-layered square architecture as well and comprises a feeding transmission line layer 600, three layers of dielectric layers (not shown), a metal grounding plate 620, a lower planar dual polarization antenna layer 640 and a upper planar dual polarization antenna layer 660. Unlike the planar dual polarization antenna 10, the metal grounding plate 620 can be divided into rectangular regions SC1 and SC2 with slots SL_1*a*, SL_1*b*, SL_2*a* and SL_2*b*, respectively. The slots SL_1*a*, SL_1*b*, SL_2*a* and SL_2*b* on the rectangular regions SC1 and SC2 are disposed corresponding to feeding transmission lines FTL_1*a*, FTL_1*b*, FTL_2*a* and FTL_2*b* of the feeding transmission line layer 600 to feed in radio signals of two polarizations. The lower planar dual polarization antenna layer 640 comprises lower patch plates DPP_1 and DPP_2 with a shape substantially conforming to a cross pattern, and the upper planar dual polarization antenna layer 660 comprises upper patch plates UPP_1 and UPP_2 with a shape substantially conforming to the cross quadrate pattern 21. The lower patch plates DPP_1 and DPP_2 are disposed corresponding to the rectangular regions SC1 and SC2, and the upper patch plates UPP_1 and UPP_2 are disposed corresponding to the lower patch plates DPP_1 and DPP_2. The maximum dimensions of the upper patch plates UPP_1 and UPP_2 along the directions x and y are equal to the reference dimension D corresponding to the resonance bandwidth. In other words, the upper patch plates UPP_1 and UPP_2 do not extend or contract in one direction only (such as the direction x or y), and the ratio values Ax and Ay are equal to 1. Therefore, the dimensions of the upper patch plates UPP_1 and UPP_2 are directly related to antenna operation frequency. In such a situation, each geometry center and its symmetry center are separated by equal distance. For example, a geometry center G_U6 of the upper patch plate UPP_1 and a symmetry center SCENE of the upper patch plate UPP_1 are separated by a distance DIS_U6. A geometry center G_R6 of the upper patch plate UPP_1 and the symmetry center SCENE are separated by a distance DIS_R6 equal to the distance DIS_U6.

Technically, because an LTE base station is generally located near the ground, radiation power of the complex antenna 60 should be concentrated in vertical plane (i.e., the yz plane) within plus or minus 10 degrees elevation angle with respect to the horizon, considering the distance between an LTE base station and a user. In such a situation, the lower patch plates DPP_1 and DPP_2 vertically aligned to forma 1×2 array antenna can ensure that antenna gain meets system requirements. Moreover, the length L1 of the rectangular regions SC1 and SC2 along the symmetry axis axis_y is longer than the width W1 of the rectangular regions SC1 and SC2 along the direction x, thereby increasing 3 dB beamwidth in horizontal plane (i.e., the xz plane). Table 1 is an antenna characteristic table for the complex antenna 60. As can be seen from Table 1, the complex antenna 60 meets LTE wireless communication system requirements for maximum gain and front-to-back (F/B) ratio. Furthermore, as the width W1 of the metal grounding plate 620 shrinks from 100 mm to 70 mm, the beamwidth in horizontal plane can increase to 69.5-73.0 degrees.

TABLE 1

| | | | | |
|---|---|---|---|---|
| a total length L of the metal grounding plate 620 (mm) | 200 | 200 | 200 | 200 |
| the width W1 of the metal grounding plate 620 (mm) | 100 | 90 | 80 | 70 |
| maximum gain (dBi) | 11.0-11.6 | 10.9-11.5 | 10.7-11.3 | 10.5-11.1 |
| front-to-back (F/B) ratio (dB) | 11.5-12.7 | 11.4-12.4 | 11.4-12.7 | 10.1-11.1 |
| 3 dB beamwidth in horizontal plane | 62.0°-65.5° | 64.0°-68.5° | 68.0°-70.5° | 69.5°-73.0° |
| Co/Cx value in horizontal plane within ±30° (dB) | 19.8-23.8 | 19.1-22.5 | 17.4-20.9 | 14.7-19.8 |
| Co/Cx value in vertical plane within ±10° (dB) | 22-29 | 20-29 | 18-29 | 14-28 |

Figure 7:
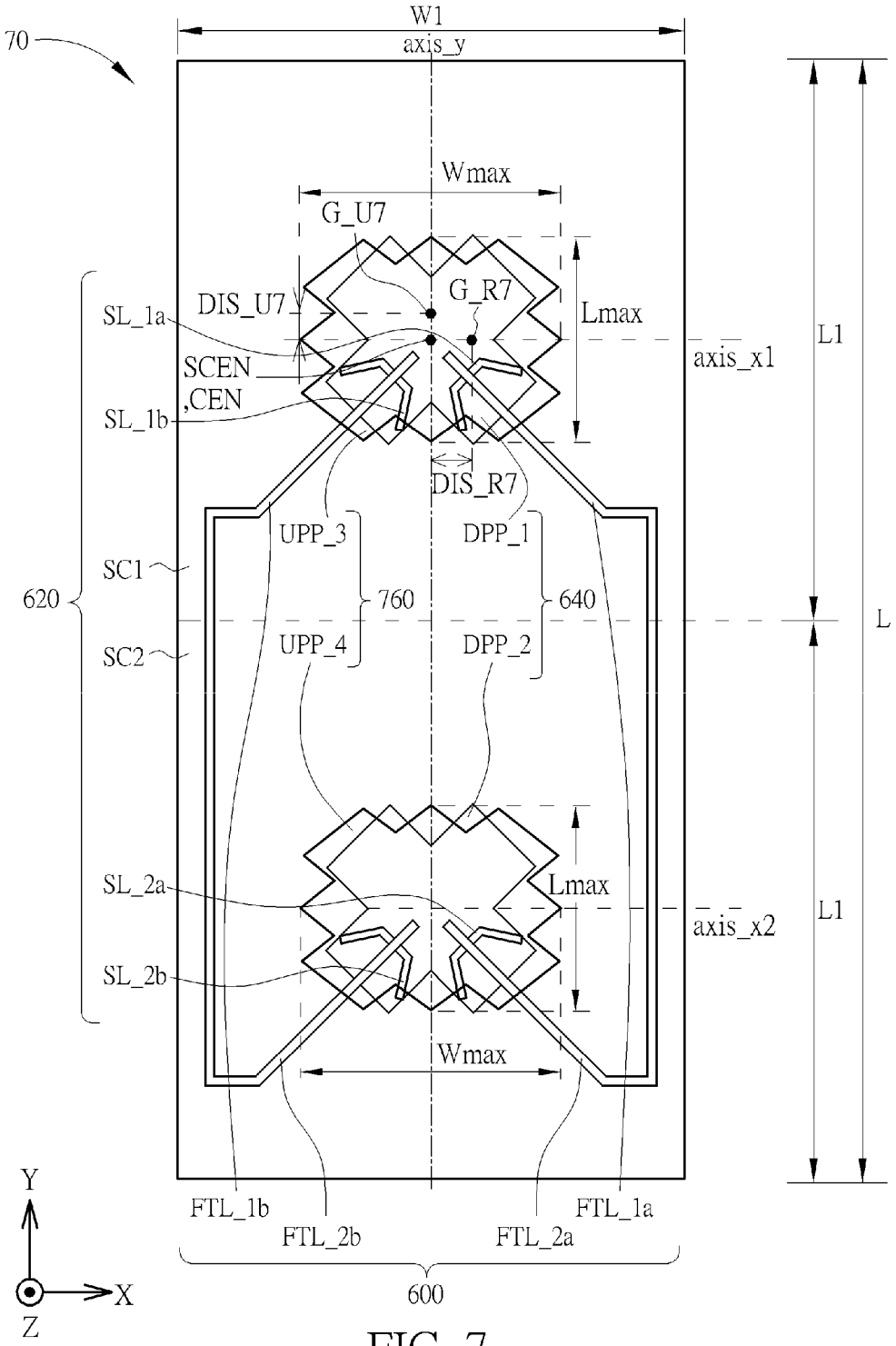
FIG. 7 is a top-view schematic diagram illustrating a complex antenna according to an embodiment of the present invention.

To further improve Co/Cx value of the complex antenna 60, the shape of the upper patch plates UPP_1 and UPP_2 may be modified to in order to balance the inequivalence of the length L1 and the width W1. FIG. 7 is a top-view schematic diagram illustrating a complex antenna 70 according to an embodiment of the present invention. The structure of the complex antenna 70 is similar to that of the complex antenna 60, and hence the same numerals and notations denote the same components in the following description. Unlike the complex antenna 60, the maximum width Wmax of upper patch plates UPP_3 and UPP_4 of a upper planar dual polarization antenna layer 760 along the direction x is longer than the maximum length Lmax along the direction y to balance the asymmetry of the rectangular regions SC1 and SC2 of the metal grounding plate 620 caused by the inequivalence of the length L1 and the width W1. According to the extent to which the length L1 is longer than the width W1, the upper patch plates UPP_3 and UPP_4 extend along the direction x or contract along the direction y if compared with the reference dimension D of the complex antenna 60. The ratio value Ax is therefore greater than the ratio value Ay, and each geometry center and its symmetry center are separated by unequal distance. For example, a geometry center G_U7 of the upper patch plate UPP_3 and the symmetry center SCEN of the upper patch plate UPP_3 are separated by a distance DIS_U7. A geometry center G_R7 of the upper patch plate UPP_3 and the symmetry center SCEN are separated by a distance DIS_R7 less than the distance DIS_U7. Moreover, as the planar dual polarization antenna 10 can be arranged in rows and columns to form the complex antenna 70, the planar dual polarization antennas 30, 40 and 50 can also be arrayed to form the complex antenna 70.

In other words, with the array antenna structure, antenna gain of the complex antenna 70 increases. And the width W1 of the rectangular regions SC1 and SC2 is shortened to increase beamwidth. In order to balance inequivalence of the length L1 and the width W1, the upper patch plates UPP_3 and UPP_4 are spread out to be more distributed along the direction x and thus improve common polarization to cross polarization (Co/Cx) value. Because the present invention merely adjusts the shape of the upper patch plates UPP_3 and UPP_4 without forming slots on the metal grounding plate 620, the metal grounding plate 620 in the present invention is confined and enclosed, such that active circuits can be disposed within shielding areas provided by the metal grounding plate 620 in order to isolate the active circuits from the complex antenna 70.

Simulation and measurement may be employed to determine whether the complex antenna 70 meets system requirements. Specifically, please refer to Tables 2, 3 and FIGS. 8A-10E. Tables 2 and 3 are simulation antenna characteristic tables for the complex antenna 70 with the upper patch plates UPP_3 and UPP_4 corresponding to sizes 1-15 respectively, wherein the total length L of the metal grounding plate 620 is 200 mm, and the width W1 is 70 mm. As can be seen from Tables 2 and 3, by properly resizing and reshaping the upper patch plates UPP_3 and UPP_4 of the complex antenna 70, antenna characteristics can be changed. In particular, when the ratio value Ax increases to 1.02, or when the ratio value Ay decreases to 0.97, Co/Cx value within plus or minus 30 degrees angle can be effectively improved. Alternatively, when the ratio value Ax increases to 1.01 and the ratio value Ay decreases to 0.99, Co/Cx value within plus or minus 30 degrees angle can also be effectively improved. Because the ratio values Ax and Ay approximate 1, reshaping the upper patch plates UPP_3 and UPP_4 barely shifts resonance frequency and affects the resonance bandwidth.

TABLE 2

| | S11 parameter (dB) | iso-lation (dB) | the ratio value Ax | the ratio value Ay | maximum gain (dBi) | front-to-back (F/B) ratio (dB) |
|---|---|---|---|---|---|---|
| size 1 | >11.5 | >28.9 | 1 | 1 | 10.4-11.1 | 9.9-11.0 |
| size 2 | >11.7 | >27.7 | 1.005 | 1 | 10.5-11.0 | 9.8-11.0 |
| size 3 | >11.8 | >26.4 | 1.01 | 1 | 10.5-11.0 | 9.8-11.0 |
| size 4 | >11.8 | >25.2 | 1.015 | 1 | 10.5-10.9 | 9.8-11.0 |
| size 5 | >11.8 | >24.0 | 1.02 | 1 | 10.5-10.8 | 9.7-11.0 |
| size 6 | >10.6 | >21.7 | 1.03 | 1 | 10.5-10.7 | 9.5-10.9 |
| size 7 | >8.2 | >18.4 | 1.05 | 1 | 10.0-10.6 | 9.0-10.9 |
| size 8 | >11.3 | >28.6 | 1 | 0.995 | 10.5-11.2 | 10.1-11.2 |
| size 9 | >11.4 | >27.1 | 1 | 0.99 | 10.5-11.2 | 10.1-11.2 |
| size 10 | >11.3 | >25.8 | 1 | 0.985 | 10.5-11.2 | 10.2-11.1 |
| size 11 | >11.0 | >24.6 | 1 | 0.98 | 10.5-11.3 | 10.3-11.2 |
| size 12 | >10.9 | >23.8 | 1 | 0.975 | 10.4-11.3 | 10.3-11.3 |
| size 13 | >10.8 | >22.9 | 1 | 0.97 | 10.5-11.3 | 10.4-11.3 |
| size 14 | >10.3 | >18.6 | 1 | 0.95 | 10.4-11.3 | 10.7-11.5 |
| size 15 | >11.7 | >24.3 | 1.01 | 0.99 | 10.5-11.0 | 10.0-11.1 |

TABLE 3

| | 3 dB beamwidth in horizontal plane | Co/Cx value in horizontal plane within ±30° (dB) | Co/Cx value in vertical plane within ±10° (dB) |
|---|---|---|---|
| size 1 | 69.5°-73.5° | 14.3-19.4 | 14-26 |
| size 2 | 69.5°-73.0° | 15.1-19.0 | 15-30 |
| size 3 | 69.5°-73.5° | 15.6-19.1 | 15-32 |
| size 4 | 69.5°-72.5° | 16.2-19.4 | 16-28 |
| size 5 | 70.0°-73.0° | 16.4-19.8 | 17-25 |
| size 6 | 69.5°-73.0° | 14.9-20.5 | 18-27 |
| size 7 | 69.0°-73.0° | 11.6-22.8 | 14-29 |
| size 8 | 69.5°-73.5° | 14.9-19.4 | 15-30 |
| size 9 | 69.5°-73.0° | 15.5-19.3 | 15-35 |
| size 10 | 69.5°-73.0° | 15.9-19.6 | 16-32 |
| size 11 | 69.5°-73.5° | 16.5-20.5 | 16-27 |
| size 12 | 69.5°-73.0° | 16.8-20.6 | 17-25 |
| size 13 | 69.5°-73.0° | 17.1-21.1 | 18-26 |

TABLE 3-continued

| | 3 dB beamwidth in horizontal plane | Co/Cx value in horizontal plane within ±30° (dB) | Co/Cx value in vertical plane within ±10° (dB) |
|---|---|---|---|
| size 14 | 69.5°-73.0° | 15.5-22.9 | 18-31 |
| size 15 | 69.5°-73.0° | 16.7-20.2 | 17-26 |

Figure 8A:
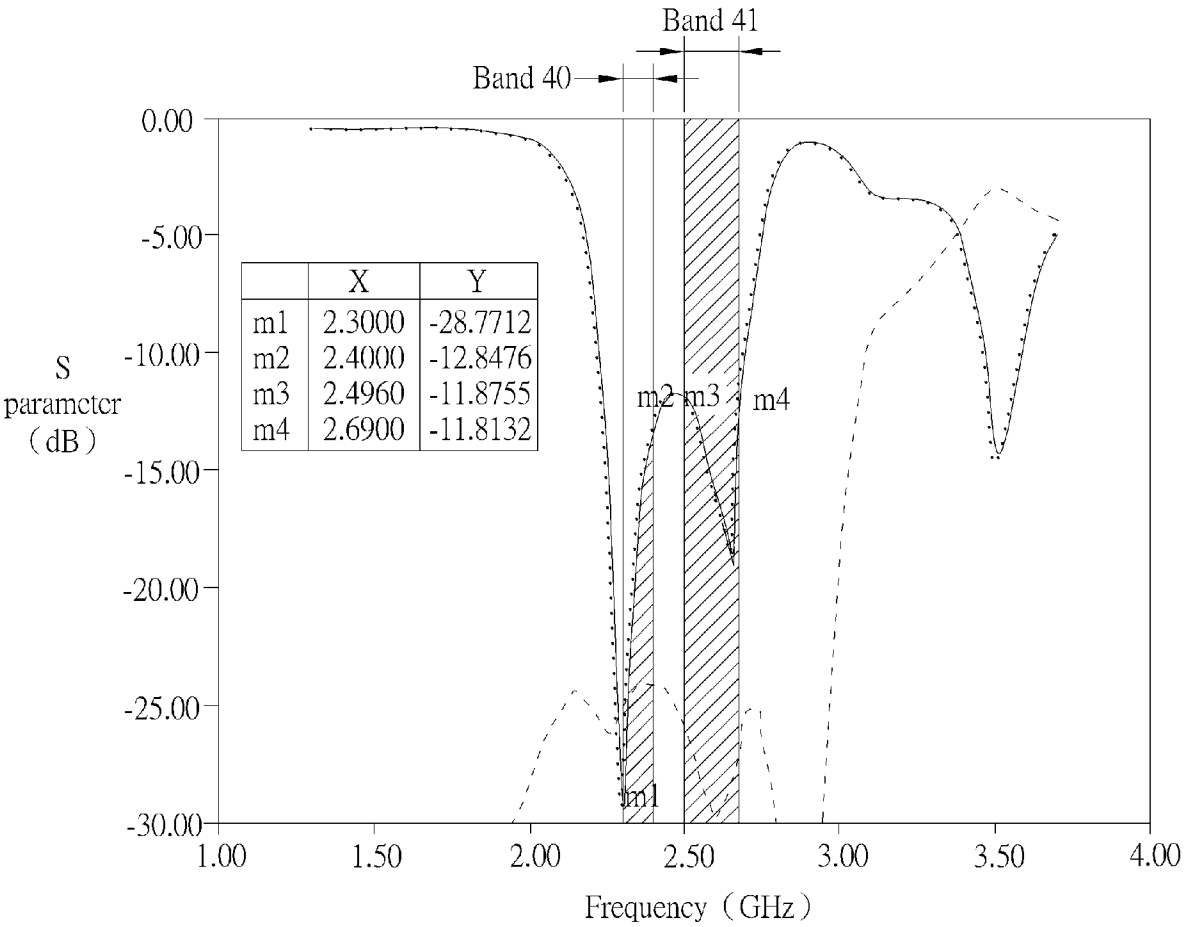
FIG. 8A is a schematic diagram illustrating antenna resonance simulation results of the complex antenna shown in FIG. 7 corresponding to size 5.
Figure 8B:
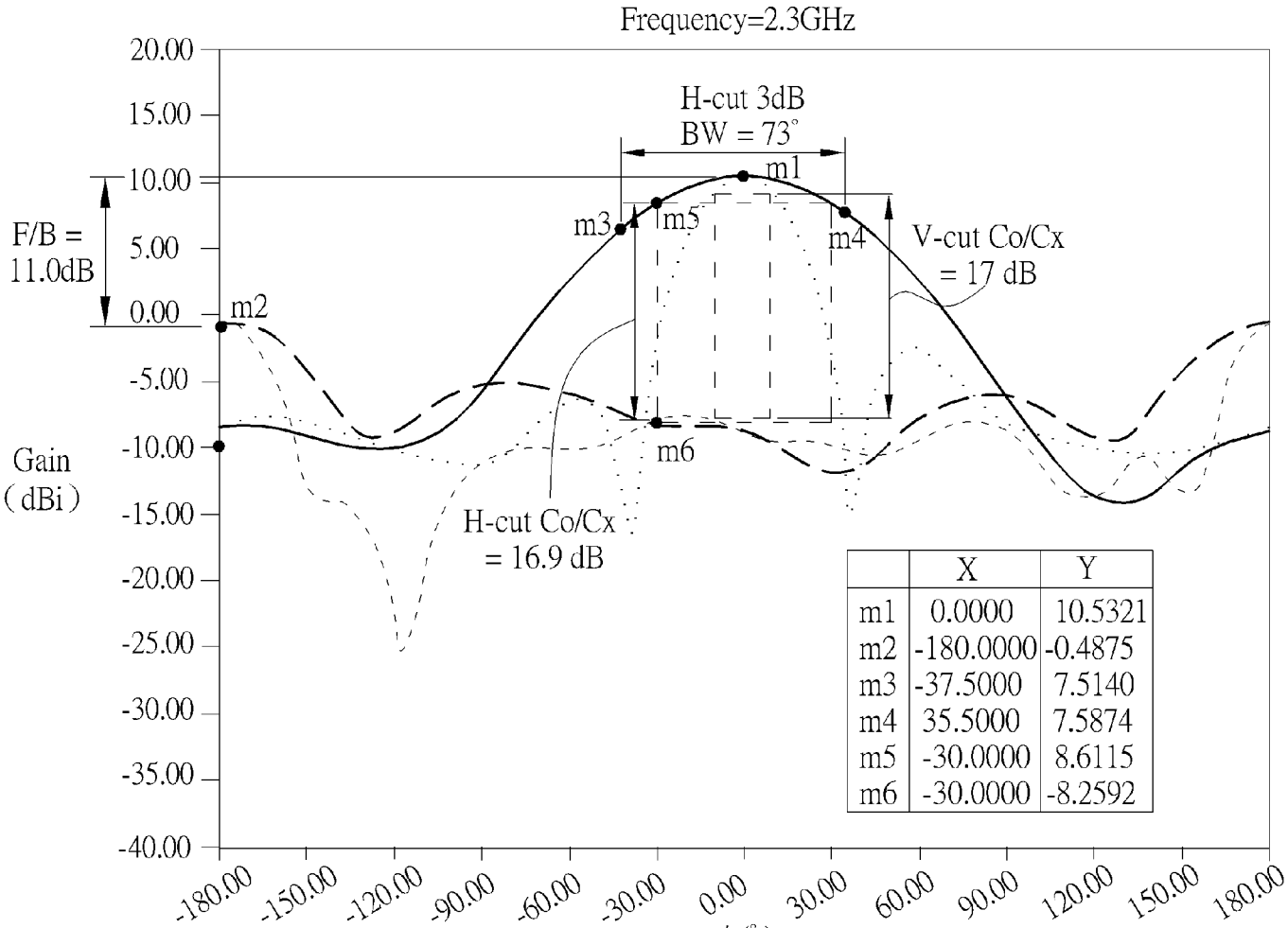
FIGS. 8B to 8E are schematic diagrams illustrating antenna pattern characteristic simulation results of the complex antenna shown in FIG. 7 corresponding to size 5 operated at 2.3 GHz, 2.4 GHz, 2.496 GHz and 2.69 GHz respectively.
Figure 8C:
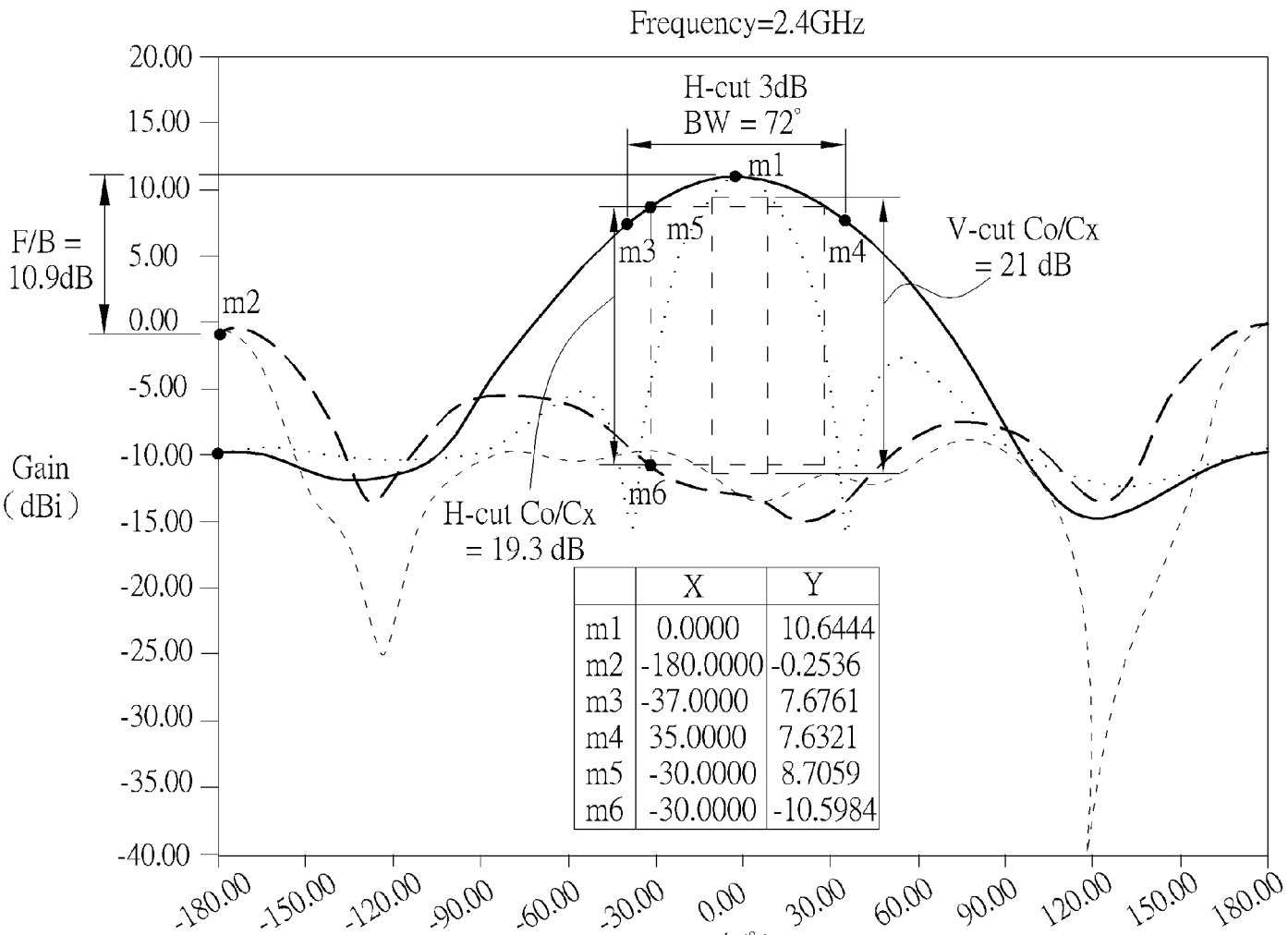
Figure 8D:
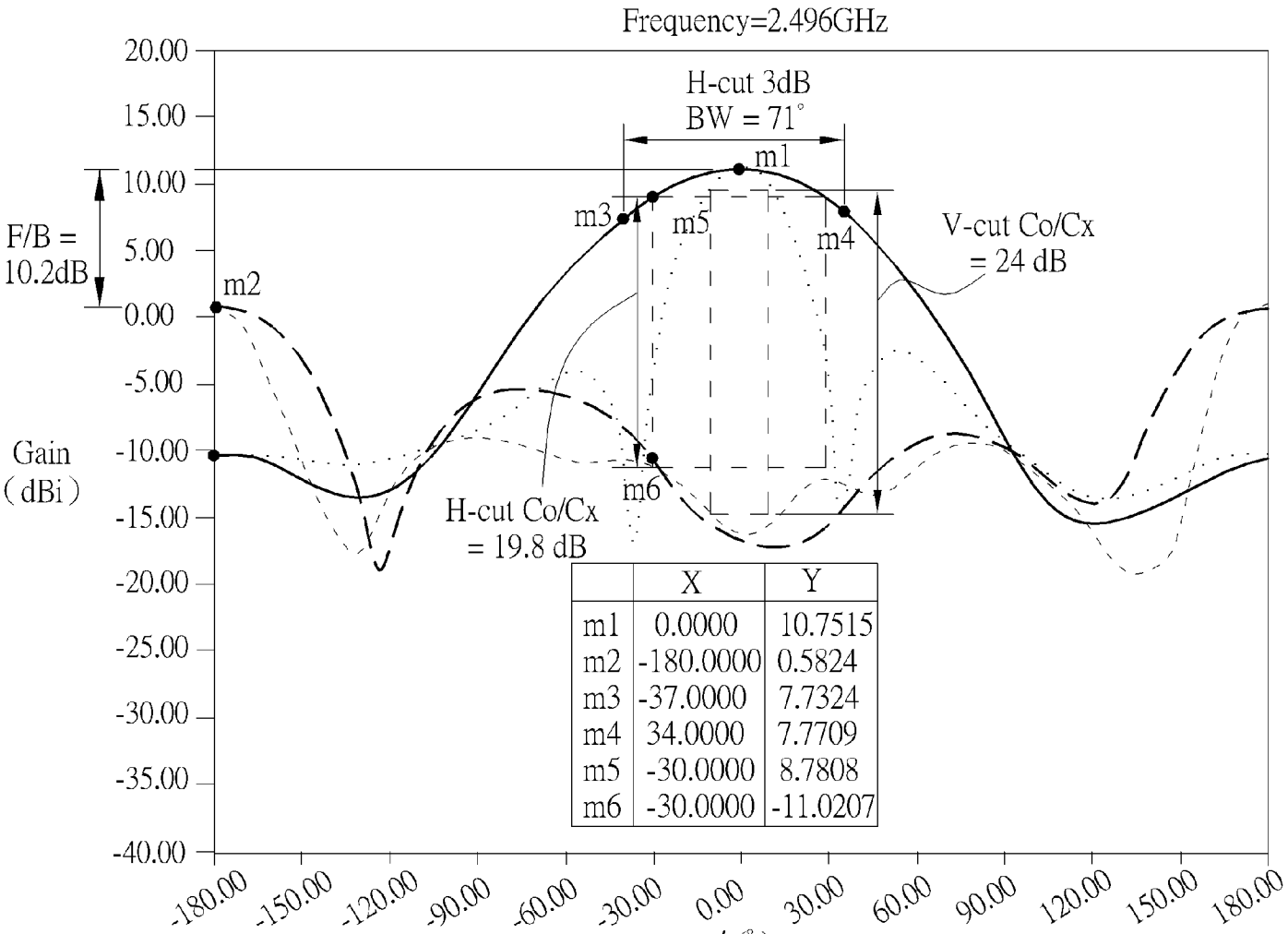
Figure 8E:
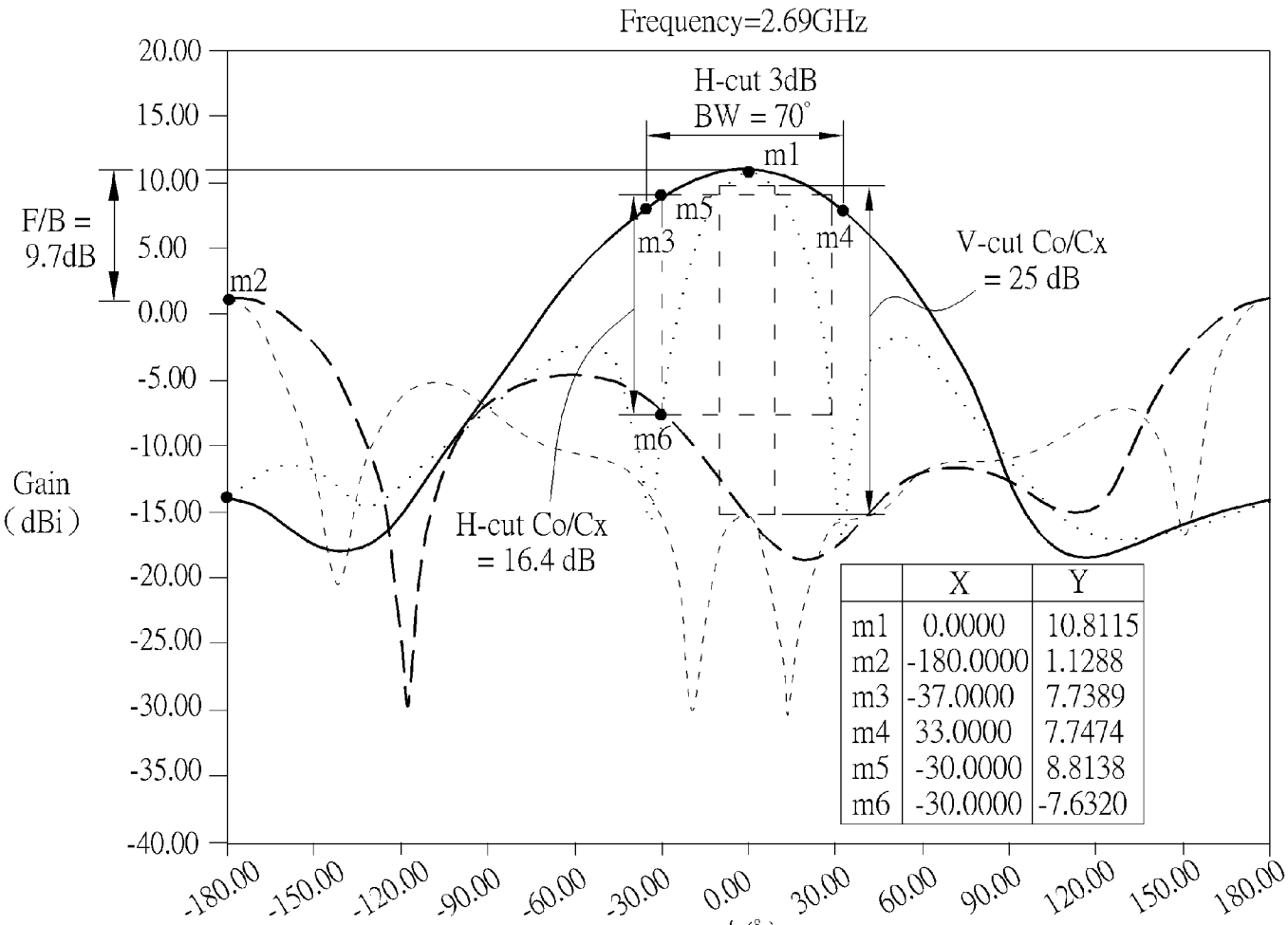
Figure 9A:
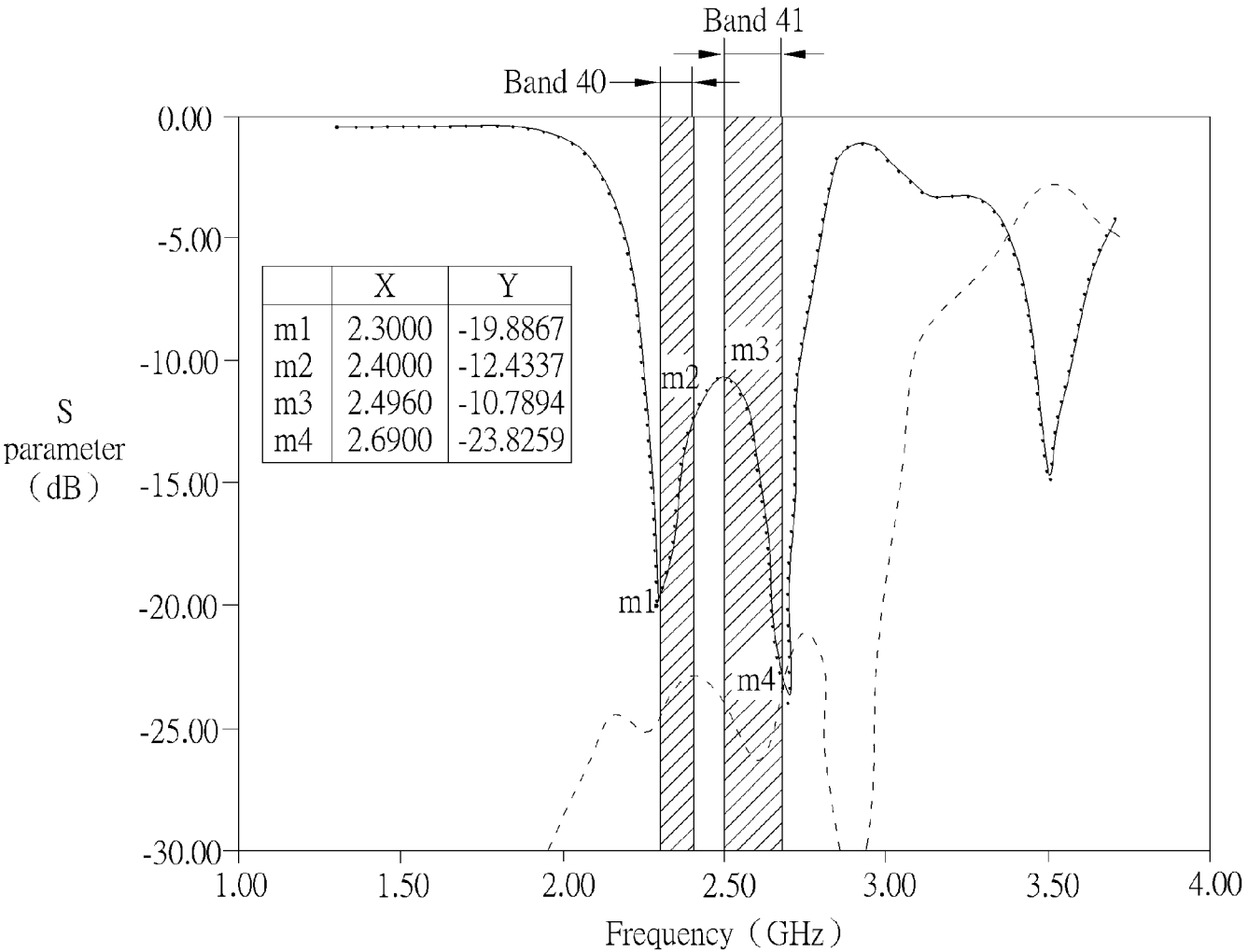
FIG. 9A is a schematic diagram illustrating antenna resonance simulation results of the complex antenna shown in FIG. 7 corresponding to size 13.
Figure 9B:
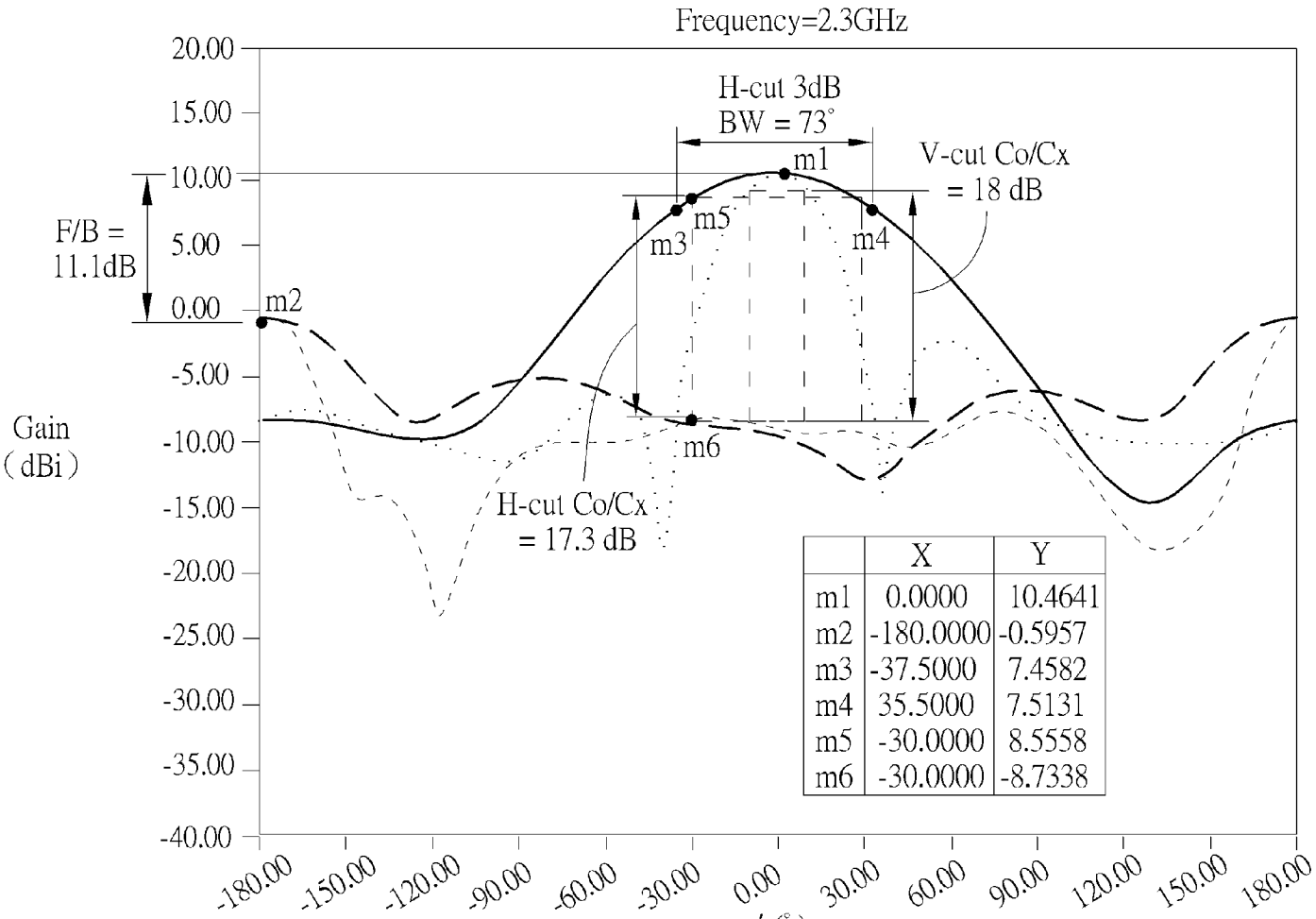
FIGS. 9B to 9E are schematic diagrams illustrating antenna pattern characteristic simulation results of the complex antenna shown in FIG. 7 corresponding to size 13 operated at 2.3 GHz, 2.4 GHz, 2.496 GHz and 2.69 GHz respectively.
Figure 9C:
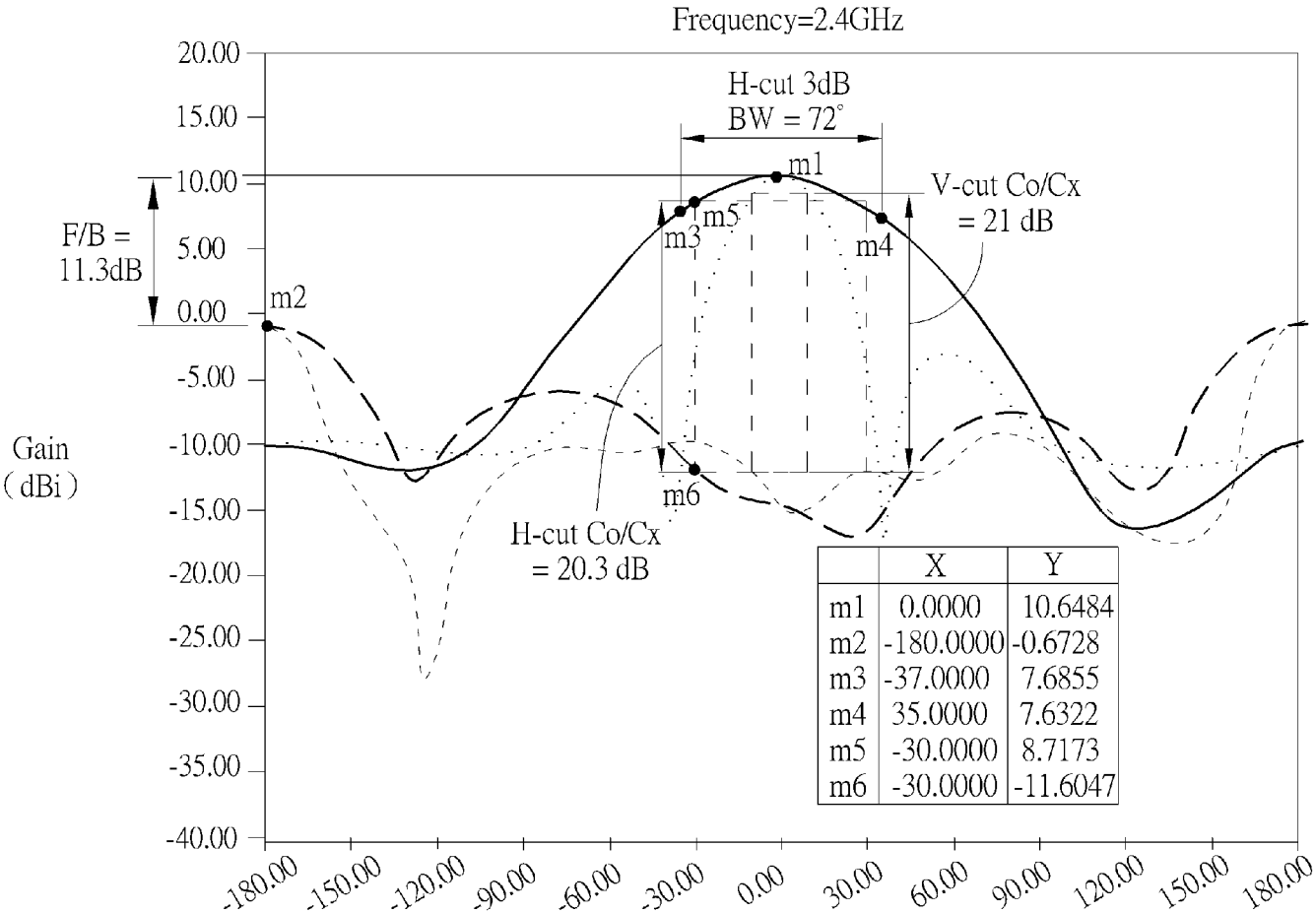
Figure 9D:
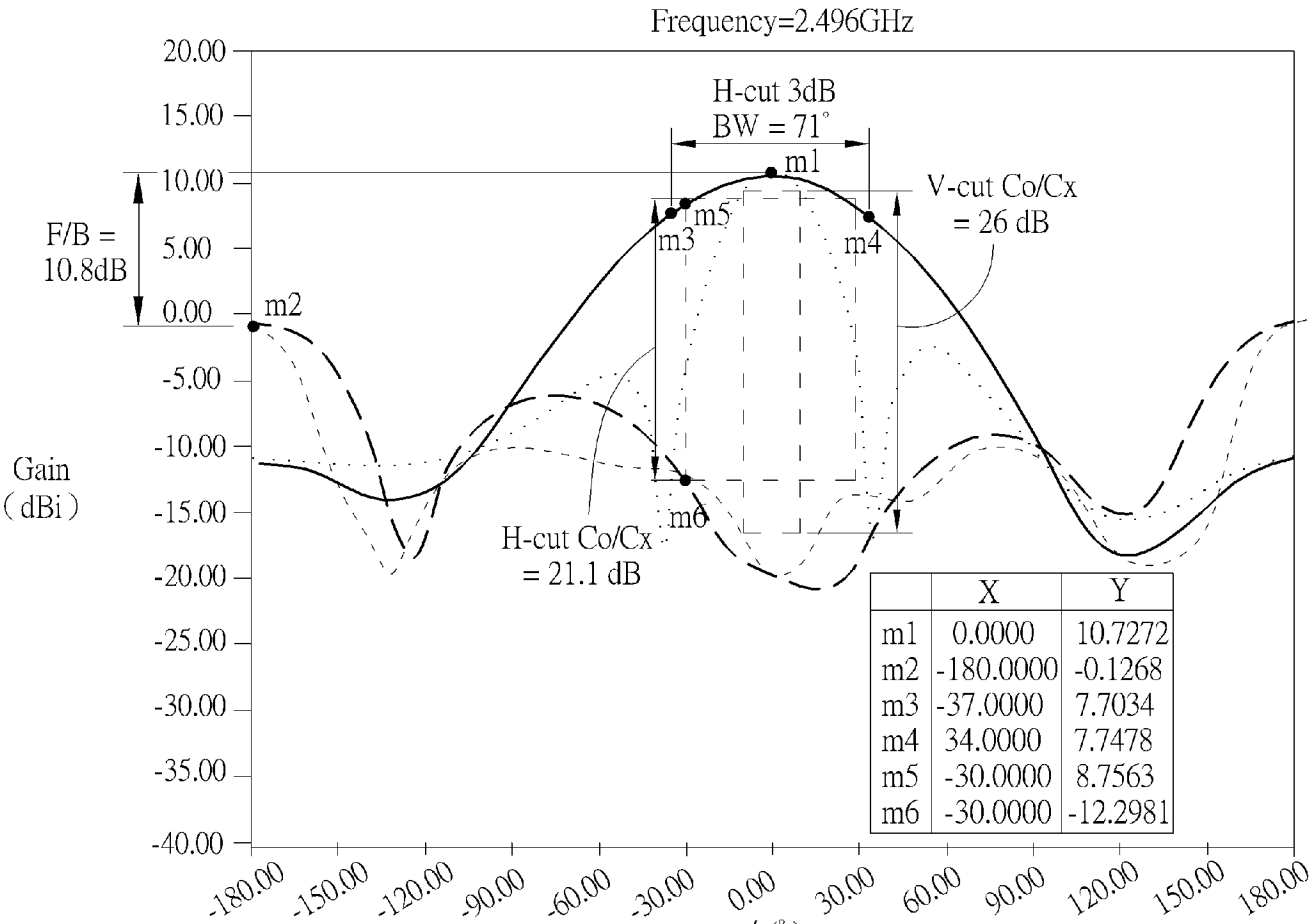
Figure 9E:
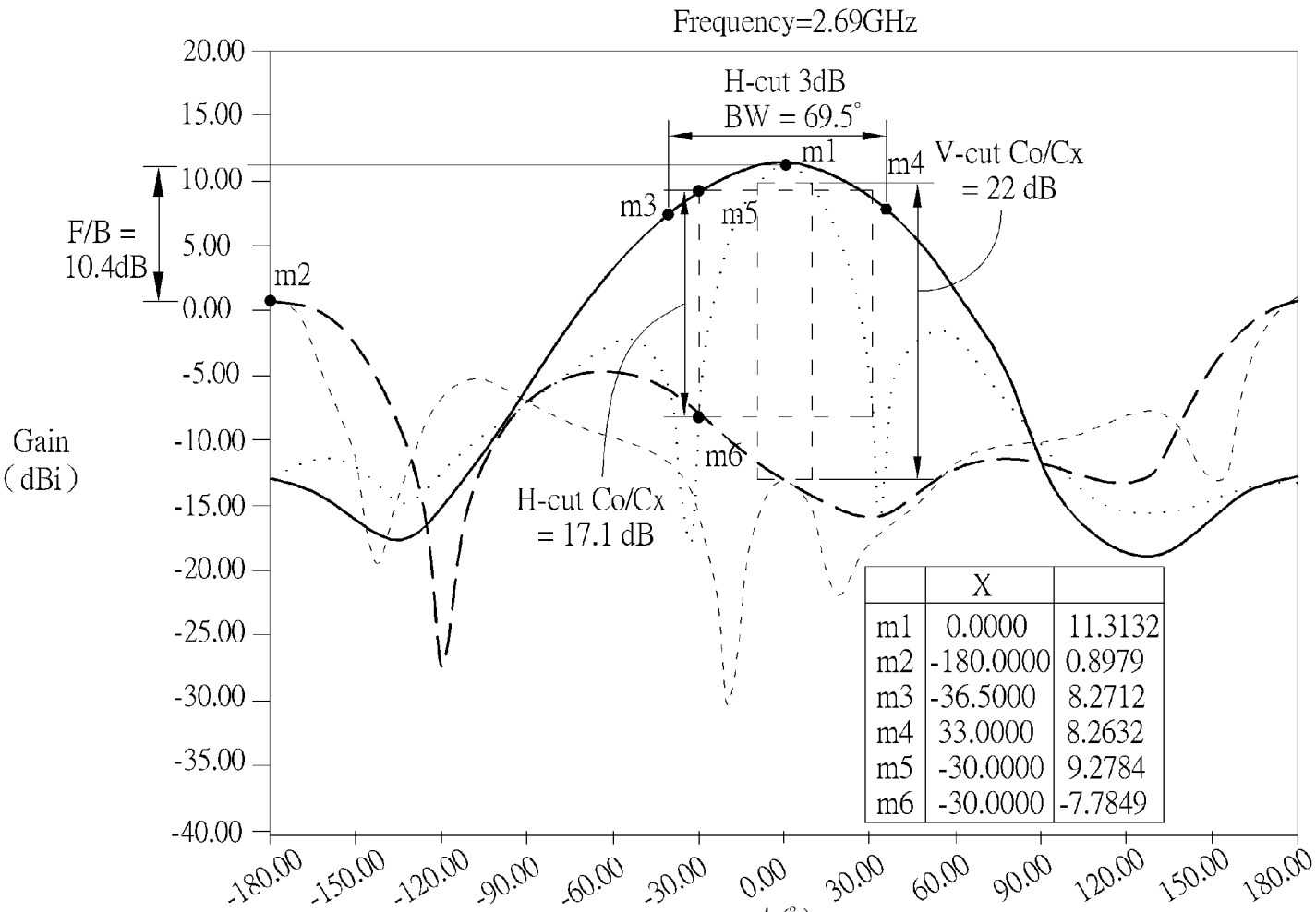
Figure 10A:
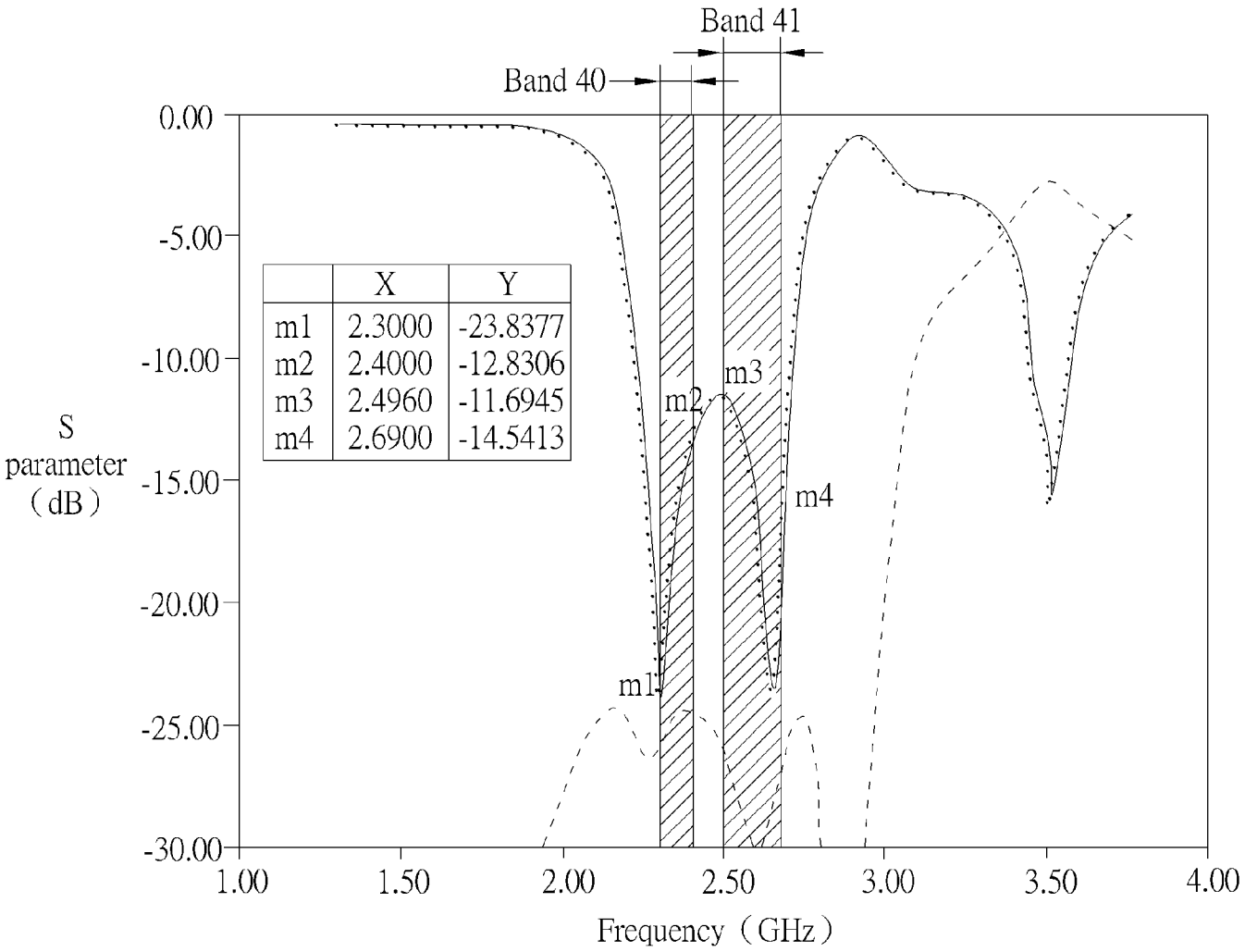
FIG. 10A is a schematic diagram illustrating antenna resonance simulation results of the complex antenna shown in FIG. 7 corresponding to size 15.
Figure 10B:
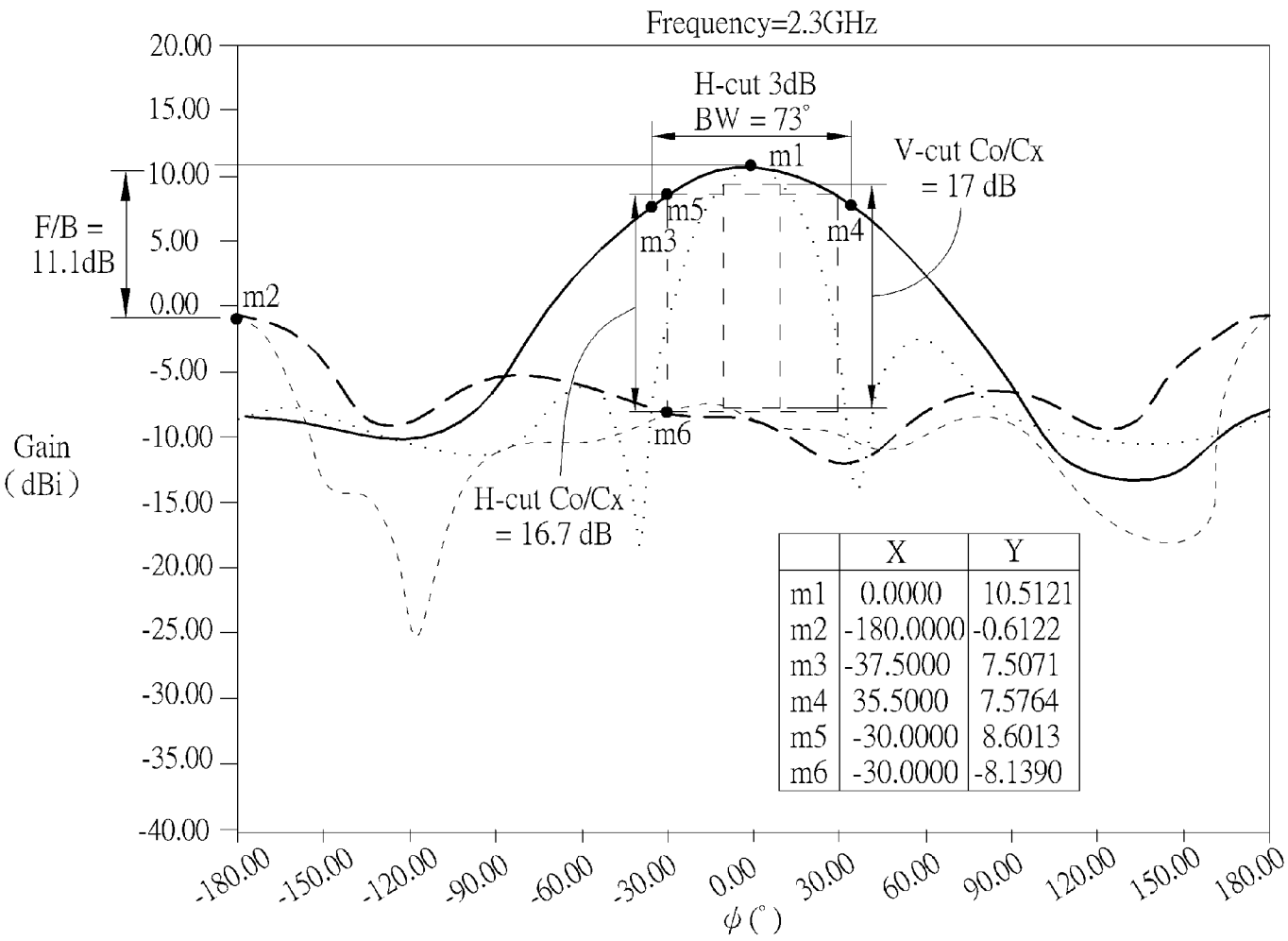
FIGS. 10B to 10E are schematic diagrams illustrating antenna pattern characteristic simulation results of the complex antenna shown in FIG. 7 corresponding to size 15 operated at 2.3 GHz, 2.4 GHz, 2.496 GHz and 2.69 GHz respectively.
Figure 10C:
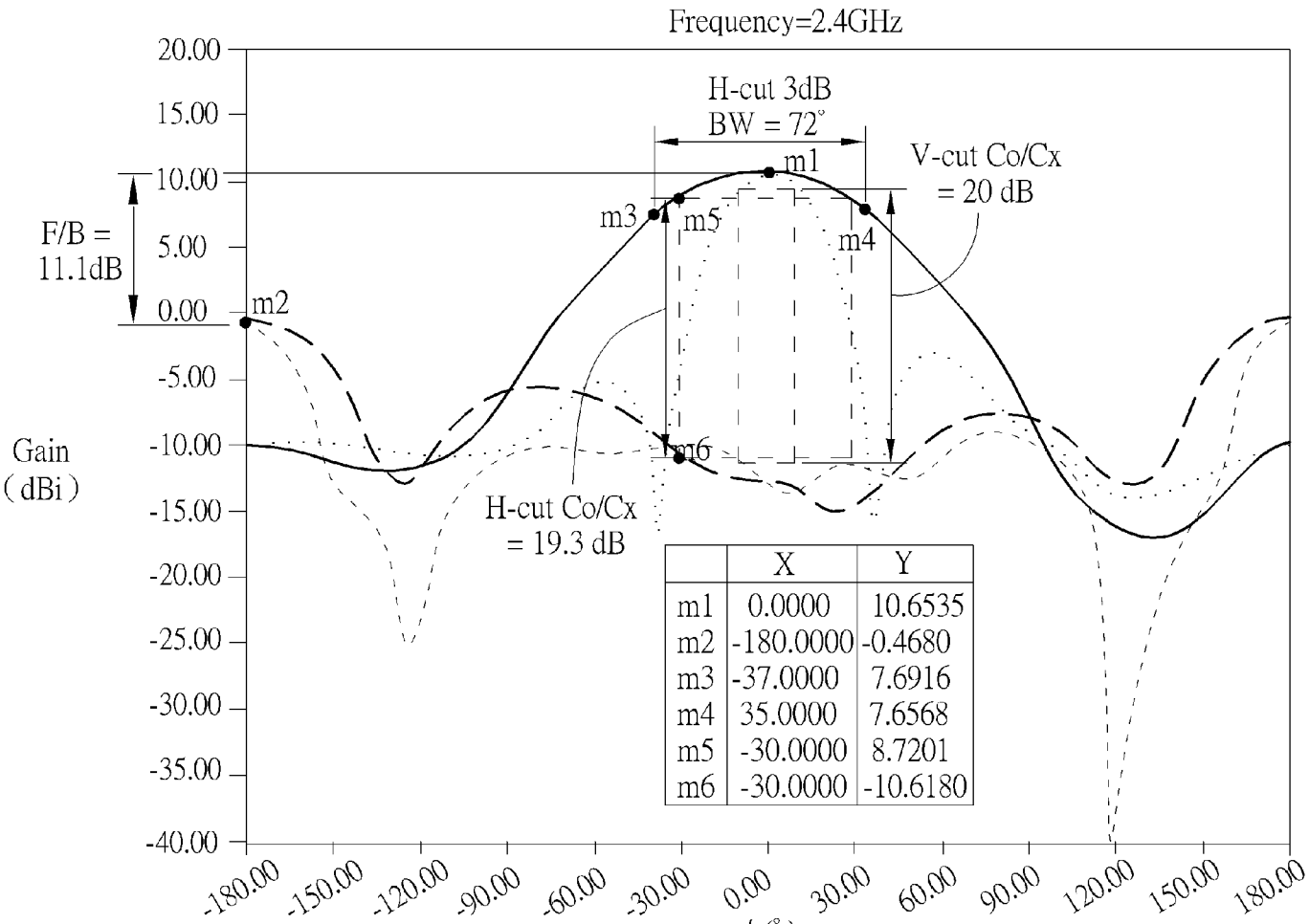
Figure 10D:
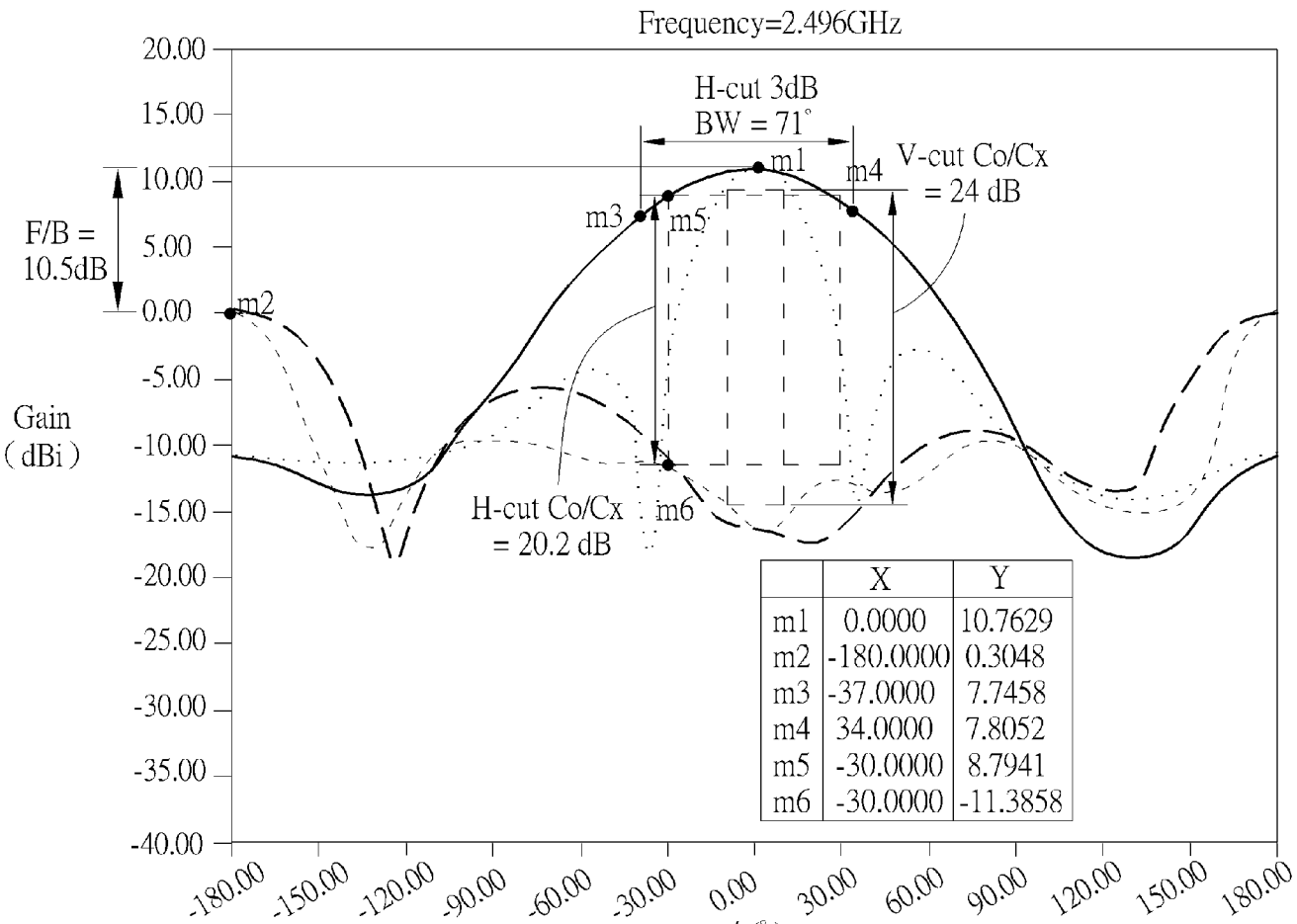
Figure 10E:
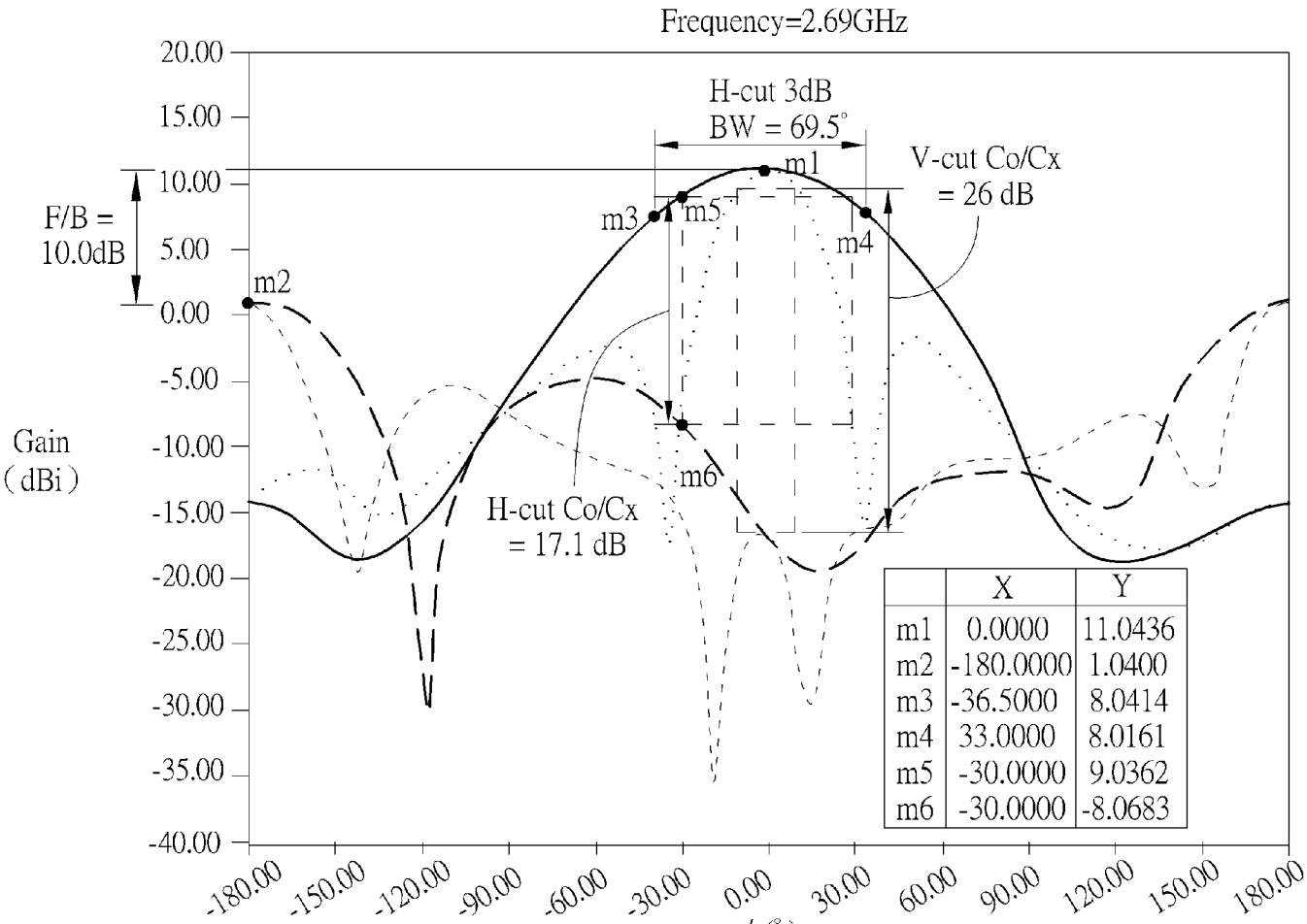

FIG. 8A is a schematic diagram illustrating antenna resonance simulation results of the complex antenna 70 corresponding to size 5 (of the ratio value Ax equal to 1.02 and the ratio value Ay equal to 1), wherein the maximum width Wmax and the maximum length Lmax are 52.89 mm and 51.85 mm, respectively. FIG. 9A is a schematic diagram illustrating antenna resonance simulation results of the complex antenna 70 corresponding to size 13 (of the ratio value Ax equal to 1 and the ratio value Ay equal to 0.97), wherein the maximum width Wmax and the maximum length Lmax are 51.85 mm and 50.30 mm, respectively. FIG. 10A is a schematic diagram illustrating antenna resonance simulation results of the complex antenna 70 corresponding to size 15 (of the ratio value Ax equal to 1.01 and the ratio value Ay equal to 0.99), wherein the maximum width Wmax and the maximum length Lmax are 52.37 mm and 51.34 mm, respectively. In FIGS. 8A, 9A and 10A, dotted and solid lines respectively indicate antenna resonance simulation results for a 45-degree slant polarization and a 135-degree slant polarization of the complex antenna 70, while a dashed line indicates antenna isolation simulation results between the 45-degree slant polarization and the 135-degree slant polarization of the complex antenna 70.

In addition, FIGS. 8B to 8E are schematic diagrams illustrating antenna pattern characteristic simulation results of the complex antenna 70 corresponding to size 5 operated at 2.3 GHz, 2.4 GHz, 2.496 GHz and 2.69 GHz respectively when applied to an LTE wireless communication system. FIGS. 9B to 9E are schematic diagrams illustrating antenna pattern characteristic simulation results of the complex antenna 70 corresponding to size 13 operated at 2.3 GHz, 2.4 GHz, 2.496 GHz and 2.69 GHz respectively when applied to an LTE wireless communication system. FIGS. 10B to 10E are schematic diagrams illustrating antenna pattern characteristic simulation results of the complex antenna 70 corresponding to size 15 operated at 2.3 GHz, 2.4 GHz, 2.496 GHz and 2.69 GHz respectively when applied to an LTE wireless communication system. In FIGS. 8B to 8E, 9B to 9E and 10B to 10E, common polarization radiation pattern of the complex antenna 70 in horizontal plane (i.e., at 0 degrees) is presented by a solid line, common polarization radiation pattern of the complex antenna 70 in vertical plane (i.e., at 90 degrees) is presented by a dotted line, cross polarization radiation pattern of the complex antenna 70 in horizontal plane is presented by a long dashed line, and cross polarization radiation pattern of the complex antenna 70 in vertical plane is presented by a short dashed line. FIGS. 8A to 10E show that the beamwidth of the complex antenna 70 in horizontal plane is wide and the complex antenna 70 meets LTE wireless communication system requirements for maximum gain and front-to-back (F/B) ratio. Besides, Co/Cx value of the complex antenna 70 can be effectively improved.

Please note that the planar dual polarization antennas 10, 30, 40, 50 and the complex antennas 60, 70 are exemplary embodiments of the invention, and those skilled in the art can make alternations and modifications accordingly. For example, portions of the feeding transmission lines 102*a*, 102*b*, FTL_1*a*, FTL_1*b*, FTL_2*a*, FTL_2*b* and the slots 122*a*, 122*b*, SL_1*a*, SL_1*b*, SL_2*a*, SL_2*b* may be modified according to different considerations, which means that degrees of the included angles enclosed by two adjacent portions can be either obtuse or acute angles, length ratios or width ratios of the portions may be changed, and the shape and the number of portions may vary. Also, having a shape "substantially conforming to a cross pattern" recited in the present invention relates to the lower patch plates 140, DPP_1, DPP_2 and the upper patch plates 160, 360, 460, 560, UPP_1, UPP_2, UPP_3, UPP_4 being formed by two overlapping and intercrossing quadrilateral patch plates. However, the present invention is not limited thereto, and any patch plate having a shape "substantially conforming to a cross pattern" is within the scope of the present invention. For example, a patch plate extends outside a quadrilateral side plate; alternatively, a patch plate extends outside a saw-tooth shaped side plate; alternatively, a patch plate further extends outside an arc-shaped side plate; alternatively, edges of a patch plate are rounded. The protrusion portions 364*a*, 364*b*, 564*a*, 564*b* and the notches 464*c*, 464*d*, 564*c*, 564*d* of the quadrilateral sections 364, 464, 564 can be quadrilateral, but the present invention is not limited thereto and other geometric patterns are also feasible. The dielectric layers 110, 130, 150 can be made of various electrically isolation materials such as air; moreover, the dielectric layers 110, 130, 150 in fact depend on bandwidth requirements and may therefore be optional. The complex antennas 60 and 70 are 1×2 array antennas, but not limited thereto and can be 1×3, 2×4 or m×n array antennas.

Figure 11:
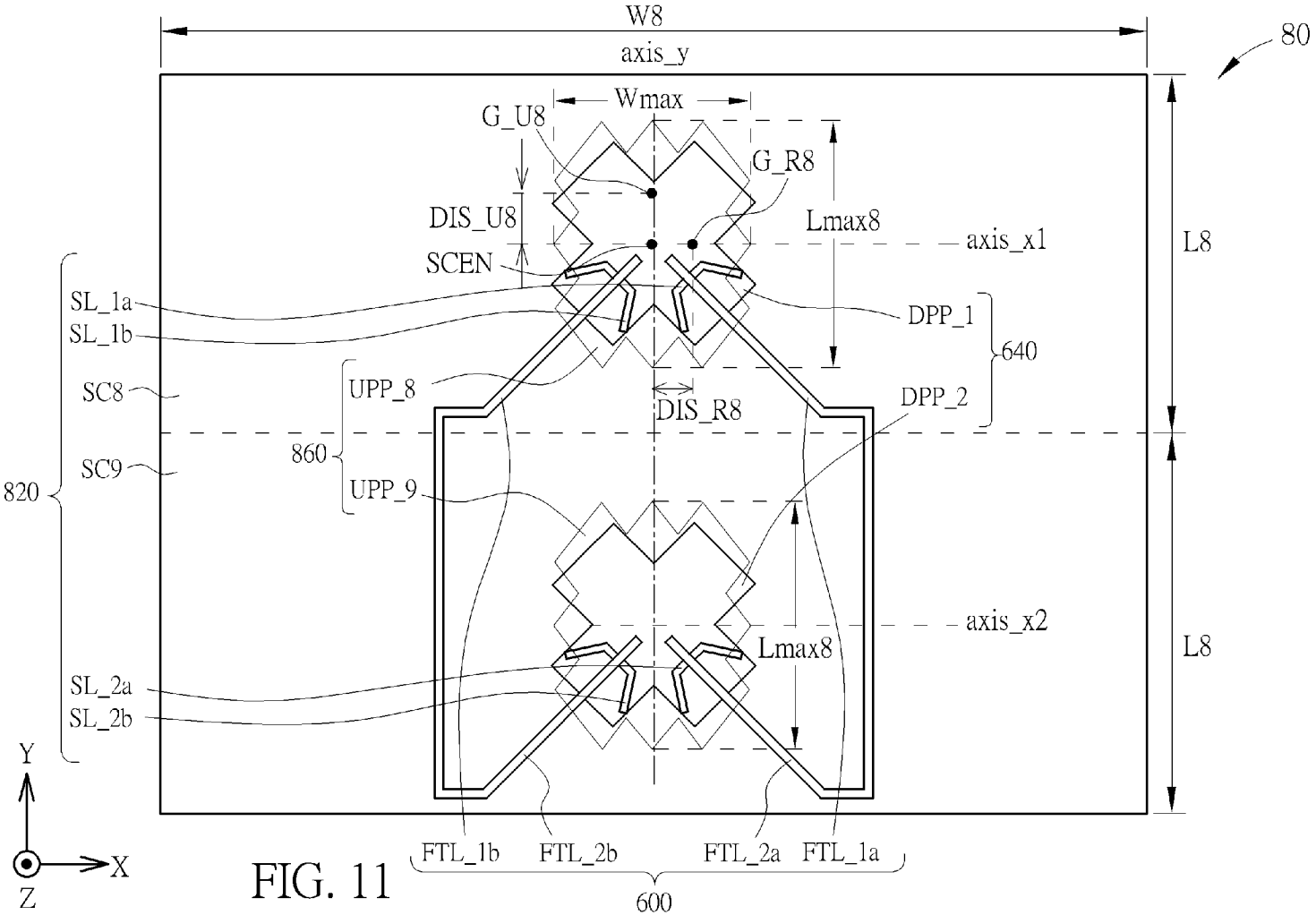
FIG. 11 is a top-view schematic diagram illustrating a complex antenna according to an embodiment of the present invention.

On the other hand, to reduce the beamwidth in horizontal plane (i.e., the xz plane), the width of the metal grounding plate along the direction x may be enlarged. FIG. 11 is a top-view schematic diagram illustrating a complex antenna 80 according to an embodiment of the present invention. The structure of the complex antenna 80 is substantially similar to that of the complex antenna 70, and the similar parts are not detailed redundantly. Different from the complex antenna 70, a width W8 of a metal grounding plate 820 along the direction x is increased to make the antenna pattern in horizontal plane converge. Therefore, a length L8 of rectangular regions SC8 and SC9 of the metal grounding plate 820 along the symmetry axis axis_y is less than the width W8 of the rectangular regions SC8 and SC9 along the direction x. Furthermore, the maximum width Wmax8 of the upper patch plates UPP_8 and UPP_9 of the upper planar dual polarization antenna layer 860 along the direction x is shorter than the maximum length Lmax8 along the direction y to balance the asymmetry of the metal grounding plate 820 caused by the inequivalence of the length L8 and the width W8. In other words, the upper patch plates UPP_8 and UPP_9 extend along the direction y or contract along the direction x, which makes the ratio value Ax less than the ratio value Ay and distances between geometry centers and the symmetry center different. For example, a geometry center G_U8 of the upper patch plate UPP_8 and the symmetry center SCEN of the upper patch plate UPP_8 are separated by a distance DIS_U8. A geometry center G_R8 of the upper patch plate UPP_8 and the symmetry center SCEN are separated by a distance DIS_R8 less than the distance DIS_U8.

To sum up, by adjusting the ratio of the length to the width of each rectangular region of the metal grounding plate corresponding to each upper patch plate, beamwidth increases. In order to balance inequivalence of the length and the width of each rectangular region, the upper patch plates are spread out to be more distributed along one specific direction, thereby improving Co/Cx value. Without forming slots on the metal grounding plate, the metal grounding plate in the present invention is confined and enclosed, such that active circuits can be disposed within shielding areas provided by the metal grounding plate in order to isolate the active circuits from the antenna.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A planar dual polarization antenna for receiving and transmitting radio signals, comprising:

a metal grounding plate having a width along a first direction and a length along a second direction; and an upper patch plate, wherein a shape of the upper patch plate has a first symmetry axis along the first direction and a second symmetry axis along the second direction, the first symmetry axis divides the upper patch plate into a first section and a third section, and the second symmetry axis divides the upper patch plate into a second section and a fourth section;

wherein a symmetry center of the shape is aligned to a center point of the metal grounding plate, a first geometry center of the first section and the symmetry center are separated by a first distance, and a second geometry center of the second section and the symmetry center are separated by a second distance unequal to the first distance.

2. The planar dual polarization antenna of claim 1, wherein the length of the metal grounding plate is not equal to the width of the metal grounding plate to adjust beamwidth.

3. The planar dual polarization antenna of claim 1, wherein the shape satisfies:

$$\frac{Wmax}{Ax} = \frac{Lmax}{Ay} = D,$$

wherein Wmax and Ax denote a maximum width of the shape along the first direction and a first ratio value respectively, Lmax and Ay denote a maximum length of the shape along the second direction and a second ratio value respectively, D denote a reference dimension corresponding to resonance bandwidth of the upper patch plate, the first ratio value and the second ratio value are related to the extent to which the maximum width and the maximum length are adjusted with respect to the reference dimension according to the width and the length of the metal grounding plate respectively.

4. The planar dual polarization antenna of claim 1, wherein the shape of the upper patch plate is formed by overlapping a cross section and a quadrilateral section or formed from a cross section.

5. The planar dual polarization antenna of claim 4, wherein the quadrilateral section comprises a plurality of protrusion portions or a plurality of notches.

6. The planar dual polarization antenna of claim 1, further comprising:

a feeding transmission line layer comprising a first feeding transmission line and a second feeding transmission line, the first feeding transmission line and the second feeding transmission line are symmetric;

a first dielectric layer disposed between the feeding transmission line layer and the metal grounding plate;

a second dielectric layer disposed on the metal grounding plate; and a lower patch plate disposed between the second dielectric layer and the upper patch plate.

7. The planar dual polarization antenna of claim 6, wherein the metal grounding plate comprises a first slot and a second slot, the first slot and the second slot are symmetric, the first slot and the first feeding transmission line generate coupling effects, the second slot and the second feeding transmission line generate coupling effects to increase bandwidth of the planar dual polarization antenna.

8. The planar dual polarization antenna of claim 6, wherein the shape of the lower patch plate is formed by overlapping a cross section and a quadrilateral section or formed from a cross section.

9. The planar dual polarization antenna of claim 1, wherein the first distance DIS_U satisfies:

$$\mathrm{DIS_U} = \frac{\int_0^{\infty}\int_{-\infty}^{\infty} f(x, y)y\partial x\partial y}{\int_0^{\infty}\int_{-\infty}^{\infty} f(x, y)\partial x\partial y},$$

the second distance DIS_R satisfies:

$$\mathrm{DIS_R} = \frac{\int_{-\infty}^{\infty}\int_0^{\infty} f(x, y)x\partial x\partial y}{\int_{-\infty}^{\infty}\int_0^{\infty} f(x, y)\partial x\partial y},$$

wherein a direction x is the first direction, a direction y is the second direction, coordinates (x,y) of the symmetry center are labeled as (x,y)=(0,0), an output of an function f(x,y) corresponding to an input (x,y) located within the upper patch plate satisfies f(x,y)=1, and an output of the function f(x,y) corresponding to an input (x,y) located outside the upper patch plate satisfies f(x,y)=0.

10. A complex antenna for receiving and transmitting radio signals, comprising:

a metal grounding plate comprising a plurality of rectangular regions, each of the plurality of rectangular regions has a width along a first direction and a length along a second direction; and an upper planar dual polarization antenna layer comprising a plurality of upper patch plates disposed corresponding to the plurality of rectangular regions respectively, wherein a shape of each of the plurality of the upper patch plates has a first symmetry axis along the first direction and a second symmetry axis along the second direction, the first symmetry axis divides the upper patch plate into a first section and a third section, and the second symmetry axis divides the upper patch plate into a second section and a fourth section;

wherein a symmetry center of the shape is aligned to a center point of the corresponding rectangular region, a first geometry center of the first section and the symmetry center are separated by a first distance, and a second geometry center of the second section and the symmetry center are separated by a second distance unequal to the first distance.

11. The complex antenna of claim 10, wherein the length is not equal to the width to adjust beamwidth.

12. The complex antenna of claim 10, wherein the shape of each of the plurality of the upper patch plates satisfies:

$$\frac{Wmax}{Ax} = \frac{Lmax}{Ay} = D,$$

wherein Wmax and Ax denote a maximum width of the shape along the first direction and a first ratio value respectively, Lmax and Ay denote a maximum length of the shape along the second direction and a second ratio value respectively, D denote a reference dimension corresponding to resonance bandwidth of the upper patch plate, the first ratio value and the second ratio value are related to the extent to which the maximum width and the maximum length are adjusted with respect to the reference dimension according to the width and the length of the metal grounding plate respectively.

13. The complex antenna of claim 10, wherein the shape of each of the plurality of the upper patch plates is formed by overlapping a cross section and a quadrilateral section or formed from a cross section.

14. The complex antenna of claim 13, wherein the quadrilateral section comprises a plurality of protrusion portions or a plurality of notches.

15. The complex antenna of claim 10, further comprising:

a feeding transmission line layer comprising a plurality of first feeding transmission lines and a plurality of second feeding transmission lines, each of the plurality of first feeding transmission lines and each of the plurality of second feeding transmission lines are disposed corresponding to one of the plurality of the upper patch plates, the first feeding transmission line and the second feeding transmission line are symmetric;

a first dielectric layer disposed between the feeding transmission line layer and the metal grounding plate;

a second dielectric layer disposed on the metal grounding plate; and a lower planar dual polarization antenna layer disposed between the second dielectric layer and the upper planar dual polarization antenna layer, comprising a plurality of lower patch plates, the plurality of lower patch plates are disposed corresponding to the plurality of the upper patch plates respectively.

16. The complex antenna of claim 15, wherein the metal grounding plate comprises a plurality of first slots and a plurality of second slots, the plurality of first slots and the plurality of second slots are symmetric respectively, each of the plurality of the first slots and the corresponding first feeding transmission line generate coupling effects, each of the plurality of the second slots and the corresponding second feeding transmission line generate coupling effects to increase bandwidth of the complex antenna.

17. The complex antenna of claim 15, wherein the shape of the lower patch plate is formed by overlapping a cross section and a quadrilateral section or formed from a cross section.

18. The complex antenna of claim 10, wherein the first distance DIS_U of each of the plurality of the upper patch plates satisfies:

$$\mathrm{DIS_U} = \frac{\int_{0}^{\infty}\int_{-\infty}^{\infty} f(x, y)y\partial x\partial y}{\int_{0}^{\infty}\int_{-\infty}^{\infty} f(x, y)\partial x\partial y},$$

the second distance DIS_R satisfies:

$$\mathrm{DIS_R} = \frac{\int_{-\infty}^{\infty}\int_{0}^{\infty} f(x, y)x\partial x\partial y}{\int_{-\infty}^{\infty}\int_{0}^{\infty} f(x, y)\partial x\partial y},$$

wherein a direction x is the first direction, a direction y is the second direction, coordinates (x,y) of the symmetry center are labeled as (x,y)=(0,0), an output of an function f(x,y) corresponding to an input (x,y) located within the upper patch plate satisfies f(x,y)=1, and an output of the function f(x,y) corresponding to an input (x,y) located outside the upper patch plate satisfies f(x,y)=0.

* * * * *